US007228943B2

(12) United States Patent
Kugiya et al.

(10) Patent No.: US 7,228,943 B2
(45) Date of Patent: Jun. 12, 2007

(54) ELEVATOR APPARATUS WITH POSITION CORRECTION FOR OVERSPEED DETECTION

(75) Inventors: Takuo Kugiya, Tokyo (JP); Kenichi Okamoto, Tokyo (JP); Takashi Yumura, Tokyo (JP); Mineo Okada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 574 days.

(21) Appl. No.: 10/486,657

(22) PCT Filed: Sep. 26, 2002

(86) PCT No.: PCT/JP02/09934

§ 371 (c)(1),
(2), (4) Date: Feb. 12, 2004

(87) PCT Pub. No.: WO03/029123

PCT Pub. Date: Apr. 10, 2003

(65) Prior Publication Data

US 2004/0200671 A1 Oct. 14, 2004

(30) Foreign Application Priority Data

Sep. 28, 2001 (JP) ..... 2001-303120

(51) Int. Cl.
*B66B 1/34* (2006.01)

(52) U.S. Cl. ..... 187/393; 187/287; 187/305

(58) Field of Classification Search ..... 187/277, 187/286, 287, 288, 293, 295, 296, 297, 305, 187/391–393
See application file for complete search history.

(56) References Cited

U.S. PATENT DOCUMENTS

| | | | | |
|---|---|---|---|---|
| 3,747,710 | A * | 7/1973 | Winkler | 187/295 |
| 3,774,729 | A * | 11/1973 | Winkler | 187/295 |
| 3,779,346 | A * | 12/1973 | Winkler | 187/294 |
| 4,128,141 | A * | 12/1978 | Caputo et al. | 187/294 |
| 4,161,236 | A * | 7/1979 | Husson | 187/294 |
| 4,726,450 | A * | 2/1988 | Fossati et al. | 187/286 |
| 5,869,794 | A | 2/1999 | Spiess | |
| 6,170,614 | B1 | 1/2001 | Herkel et al. | |

FOREIGN PATENT DOCUMENTS

| | | |
|---|---|---|
| JP | 7-157210 | 6/1995 |

* cited by examiner

*Primary Examiner*—Jonathan Salata
(74) *Attorney, Agent, or Firm*—Leydig, Voit & Mayer, Ltd.

(57) ABSTRACT

An elevator apparatus has a criterion (overspeed levels) that changes in accordance with an operational condition of a car. The elevator apparatus also has a position information correcting means that corrects an error in value that determines the criterion. In the elevator apparatus, the overspeed levels are determined using continuous information corresponding to car position, while the continuous information is corrected using intermittent information corresponding to actual car position. According to the elevator apparatus, on-the-spot adjustment or long-time maintenance becomes unnecessary, and overspeed detection levels can easily be changed in accordance with the operation conditions of the car.

4 Claims, 22 Drawing Sheets

ELEVATOR APPARATUS WITH POSITION CORRECTION FOR OVERSPEED DETECTION

FIELD OF THE INVENTION

The present invention relates to an elevator apparatus.

BACKGROUND OF THE INVENTION

FIG. 21 is a diagram showing a safety apparatus for an elevator disclosed in U.S. Pat. No. 6,170,614. In the safety apparatus 1000, a car position detected by a car position detecting device 1002 is transmitted to a microprocessor 1006 of a speed governor 1004. The microprocessor 1006 calculates a car speed on the basis of position information of a car. A car speed thus calculated is compared with an overspeed detection level (speed limit) stored in a memory 1008 of the speed governor 1004. If the car speed exceeds the overspeed detection level, a signal is transmitted from the speed governor 1004 to an emergency stop device 1010. Then, the emergency stop device 1010 operates, so that the car makes an emergency stop.

The elevator apparatus disclosed in this U.S. patent stores a plurality of overspeed detection levels in the memory, and the microprocessor selects one overspeed detection levels from among the plurality of overspeed detection levels thereby making it possible to change the overspeed detection level. As criteria for selecting the overspeed detection level, car position information to be inputted to the microprocessor, specification data of the elevator stored in the memory and so on are exemplified.

In the elevator apparatus disclosed in the Patent, for one example of the means for detecting the car position, an ultrasonic position sensor is described. However, an ultrasonic wave has the following drawbacks: it interferes with other devices installed in an elevator shaft and is liable to be affected by them. Also, the measurable distance by the ultrasonic wave is limited. Further, it is difficult to accurately determine in advance a dimension of the elevator shaft, the distance between floors and so on. This requires an operation to store these data in the memory by on-the-spot adjustment. Furthermore, over long-time use of the elevator apparatus results in the occurrence of an error in the sensor, or a change in the dimensions of a building causes displacement of the sensor. Therefore, it is required to take countermeasures, such as changing data stored in the memory, to compensate the error or displacement.

Next, FIG. 22 is a diagram showing an elevator apparatus disclosed in Japanese Publication No. 9-165156 (A). The elevator apparatus 1022 has an elevator car 1014, a winding device 1016 serving as a car driving mechanism, a winding wire 1018, a balance weight 1020, safety switches 1022-1028, an emergency stop device 1030, a guide rail 1032, a basic drive mechanism 1034, a cable 1036, and a trigger 1038. In this construction, when the car 1014 descends or ascends, a travel parameter given to the winding device 1016 is also provided to the basic drive mechanism 1034. Therefore, the car 1014 and the trigger 1038 of the basic drive system 1034 adjacently travel in parallel. If a difference takes place between their travels, and the trigger 1038 comes in contact with any one of the safety switches 1022-1028, the trigger 1038 controls the winding device 1016 in accordance with the switch with which it comes in contact, or drives the emergency stop device 1030, so that the car 1014 stops ascending or descending.

In the elevator apparatus disclosed in Japanese Patent Publication No. 9-165156 (A), a deviation between a drive speed command value and an operation speed of the car is detected, and if the deviation exceeds a predetermined margin, the emergency stop device is operated. For that reason, the trigger, which operates the safety switches positioned on the side of the car, is fixed to a cable of the basic drive mechanism and moved in a manner so as to travel in parallel with the car. However, the trigger is liable to be affected by an operation error of the basic drive mechanism with accompanying long-time use of the elevator apparatus, accumulation of displacement due to slippage etc. between the cable and a sheave that supports the cable, or a change with time in the diameter of the sheave and so on due to wear of the sheave that transmits power to the cable.

SUMMARY OF THE INVENTION

The present invention was made in order to solve the above problems, and an object thereof is to obtain an elevator apparatus that can easily change overspeed detection levels in accordance with conditions of a car, while eliminating on-the-spot adjustment in a construction site and long-time maintenance.

In order to achieve the above object, the present invention relates to an elevator apparatus having overspeed levels that change in accordance with operation conditions of a car, wherein a means for automatically correcting an error in value that determines the above levels is provided.

Another embodiment of the present invention relates to an elevator apparatus, wherein the levels that change in accordance with the operation conditions of a car are overspeed levels for directly or indirectly braking the car when the speed of the car that is travelling exceeds a speed corresponding to any one of the above levels.

Another embodiment of the present invention relates to an elevator apparatus, wherein the above levels are determined using information corresponding to a position of a car, and a means for correcting the above information is provided.

Another embodiment of the present invention relates to an elevator apparatus, wherein, by obtaining operation command information, the overspeed levels are changed in accordance with travel to a destination floor.

Another embodiment of the present invention relates to an elevator apparatus, wherein the overspeed levels are changed in accordance with an operation speed command value.

PREFERRED EMBODIMENTS OF THE INVENTION

Figure 1:
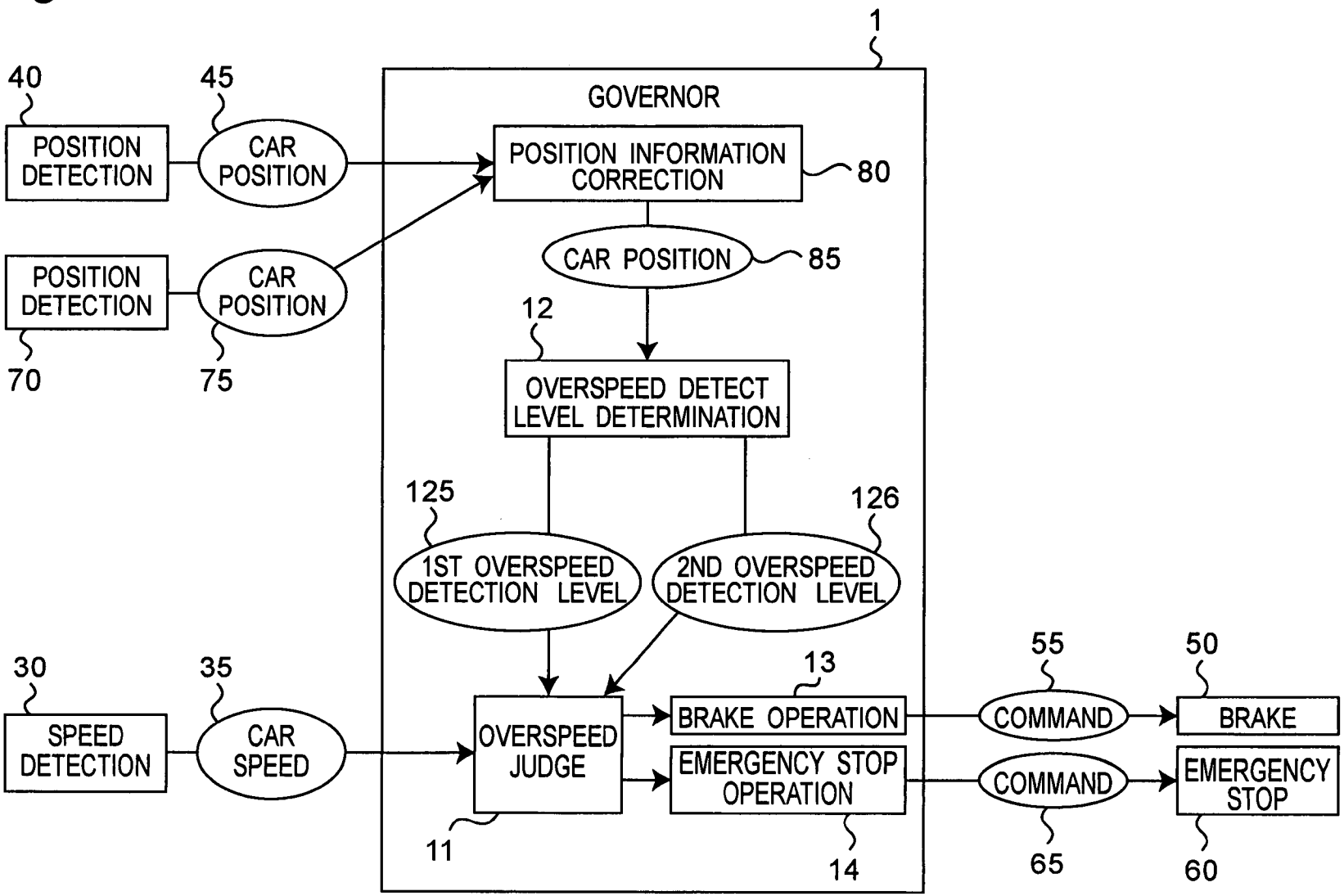
FIG. 1 is a diagram schematically and functionally showing the construction of an elevator apparatus according to a first embodiment.

A plurality of embodiments of the present invention will hereinafter be described with reference to the accompanying drawings. In the plurality of embodiments hereinafter described, like elements and like information (commands) are indicated by like reference numerals.

Embodiment 1

FIG. 1 is a diagram for schematically and functionally explaining the construction of an elevator apparatus according to a first embodiment of the present invention. In this drawing, portions each surrounded by a square frame indicates a structural component for control, and portions each surrounded by a circle or ellipse indicates information (a command) transmitted from the component. Specifically, reference numeral 1 indicates a speed governor for an elevator, reference numeral 11 indicates an overspeed travel judging means to determine whether the travel speed of a car exceeds a speed limit (overspeed) that is a predetermined criterion), reference numeral 12 indicates an overspeed detection level determining means to determine a detection level which is an overspeed value, i.e., speed limit; reference numeral 13 indicates a brake operating means for a winding machine; reference numeral 14 indicates an emergency stop operating means (emergency stop device), reference numeral 125 indicates a first overspeed detection level, reference numeral 126 indicates a second overspeed detection level, reference numeral 30 indicates a car speed detecting means which detects the speed of the car, reference numeral 35 indicates car speed information detected by the car speed detecting means 30, reference numeral 40 indicates a car position detecting means which continuously detects a position of the car, reference numeral 45 indicates car position information obtained by the car position detecting means 40, reference numeral 50 indicates a brake for a winding machine, reference numeral 55 indicates a brake operating command for the winding machine, reference numeral 60 indicates an emergency stop, reference numeral 65 indicates an emergency stop operating command, reference numeral 70 indicates a car position detecting means which intermittently detects a position of the car in an elevator shaft, reference numeral 75 indicates car position information obtained by the car position detecting means 70, reference numeral 80 indicates a position information correcting means which corrects the car position information 45 by the car position information 75, and reference numeral 85 indicates car position information corrected by the position information correcting means 80. As shown in the diagram, the speed governor 1 is electrically connected to the car speed detecting means 30, the car position detecting means 40, the brake 50, the emergency stop 60 and the car position detecting means 70, so that the above-described information transmission can be performed.

Figure 4:
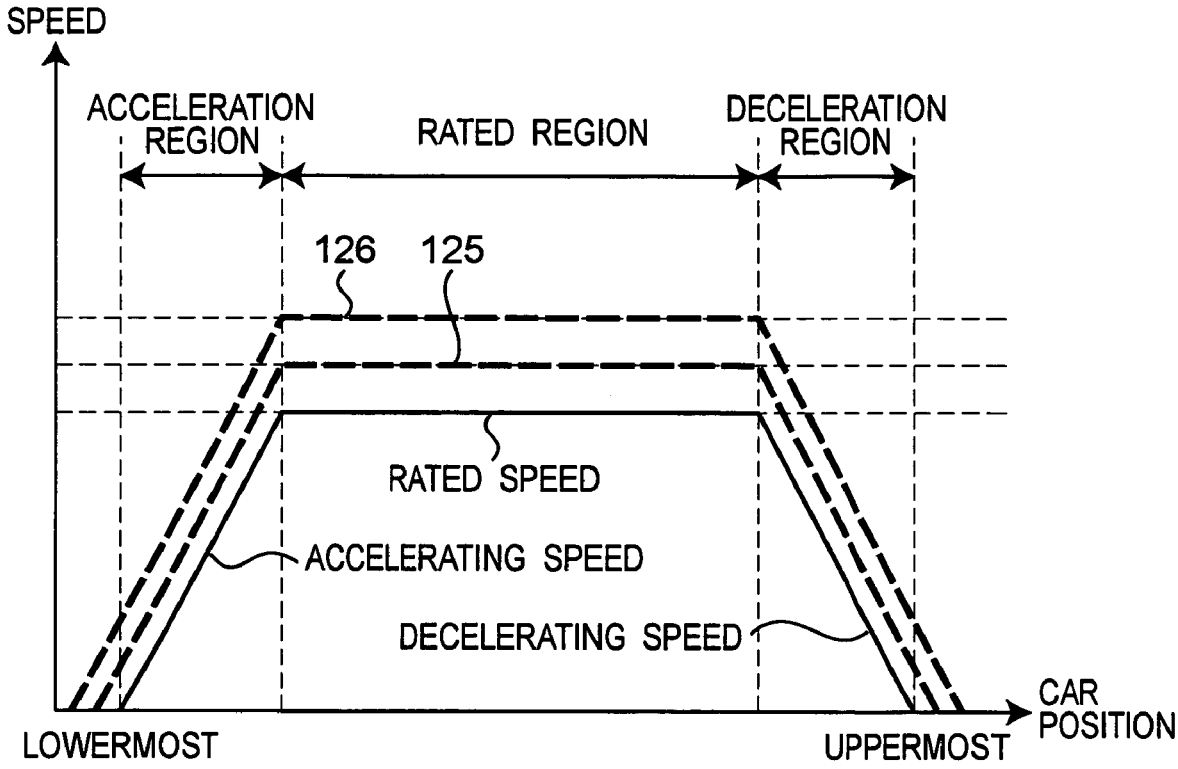
FIG. 4 is a drawing of a graph showing a relationship between a travel speed of a car and both a first and a second overspeed.
Figure 5A:
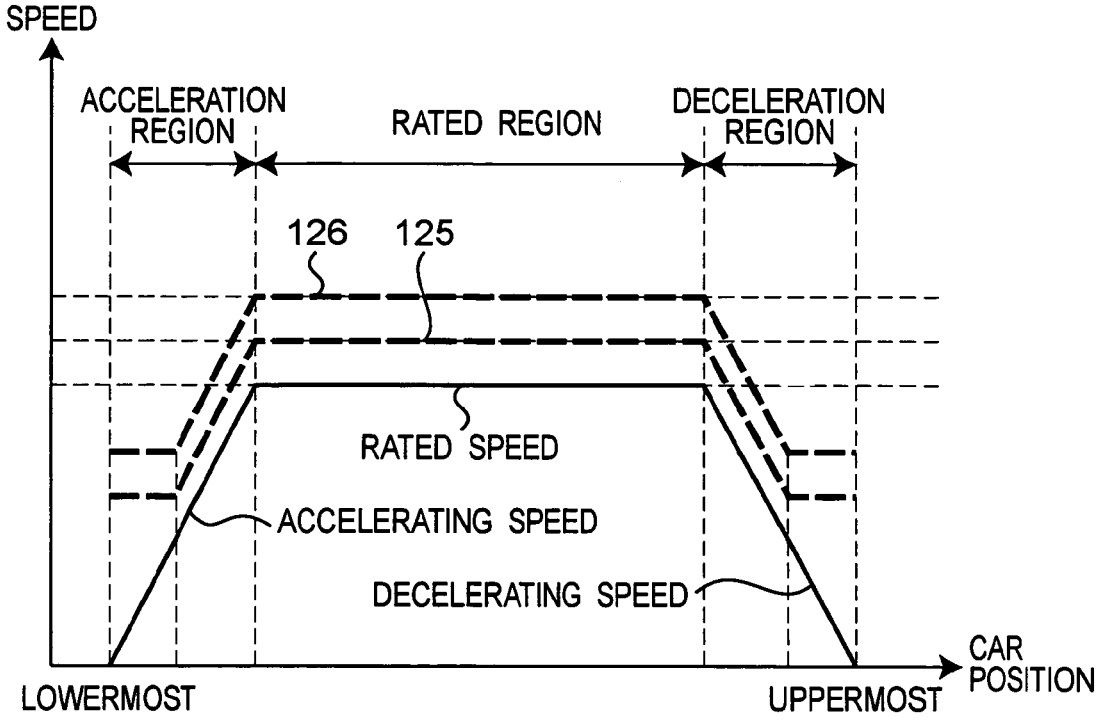
FIGS. 5A and 5B are graphs showing another relationship between a travel speed of a car and both a first and a second overspeed.
Figure 5B:
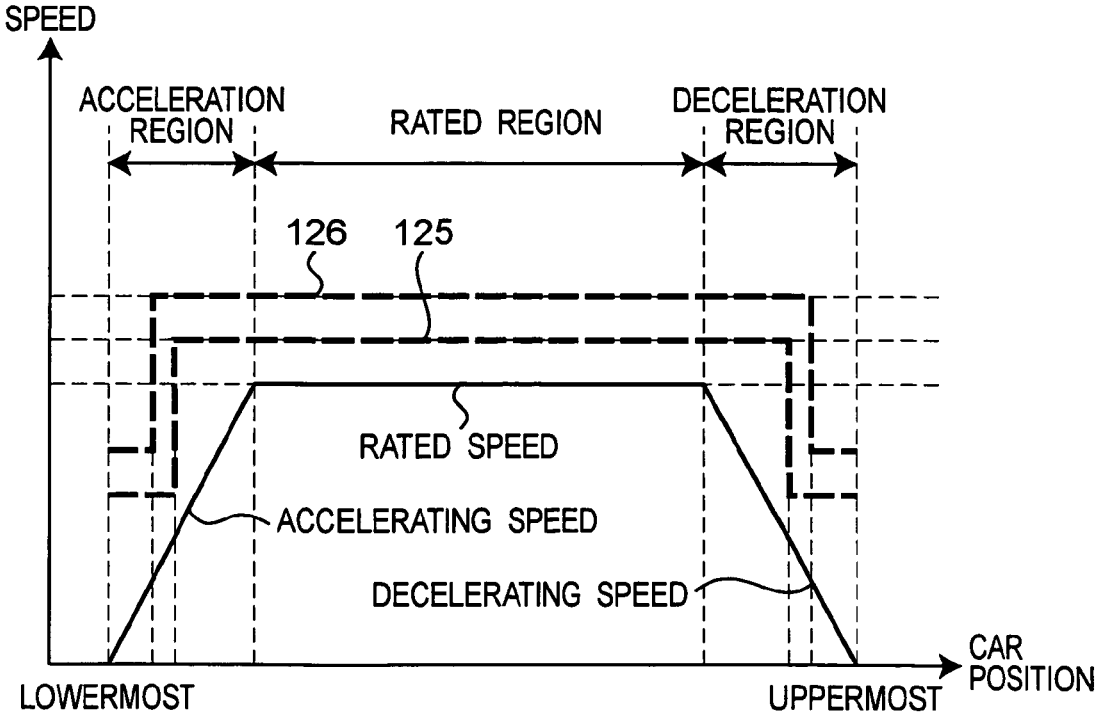

Next, an operation thereof will be described. The car speed detecting means 30 detects the car speed information 35. The car position information (continuous car position information) 45 outputted from the car position detecting means 40 and the car position information (intermittent car position information) 75 outputted from the car position detecting means 70 are inputted to the position information correcting means 80 included in the speed governor 1. The position information correcting means 80 compares the car position information 45 with the car position information (intermittent position information) 75. If there is a difference between them, the position information correcting means 80 corrects the car position information 45 on the basis of the car position information 75, and outputs the post-correction position information 85. The post-correction car position information 85 is inputted to the overspeed detection level determining means 12. The overspeed detection level determining means 12 determines and outputs the first overspeed detection level 125 and the second overspeed detection level on the basis of the car position information 85 in the whole travel of the elevator shaft 4, as shown in, for example, FIG. 4. The second overspeed detection level 126 takes a greater value than the first overspeed detection level 125. The first overspeed detection level 125 and the second overspeed detection level 126 are set to different values allowing for a driving speed pattern so that the first overspeed detection level 125 and the second overspeed detection level 126 can detect 120% and 125%, respectively, of the driving speed pattern. The driving speed pattern is defined by a trapezoidal pattern including an acceleration region during start-up, a rated speed operation region, a deceleration region approaching a destination floor. It shows a relationship between a car position (or a time) and a car speed, which is prepared when the operation from a floor (a starting floor) to another floor (a destination floor) is designated by a call button provided inside or outside the car. However, the patterns of the first overspeed detection level 125 and the second overspeed detection level 126 are not limited to those in the trapezoidal patterns. As shown in FIG. 5A, a pattern in which the speed is constant during a predetermined distance from the terminal end and is increased linearly from a position passing the predetermined region may be applied. Alternatively, as shown in FIG. 5B, a pattern in which the speed is increased or decreased stepwise at the terminal end region may be applied.

Next, the first overspeed detection level 125, the second overspeed detection level 126 and the car speed information 35 are inputted to an overspeed travel judging means 11. The overspeed travel judging means 11 compares the car speed information 35 with both the first overspeed detection level 125 and the second overspeed detection level 126. Then, if the car speed information 35 exceeds the first overspeed detection level 125, an operation signal is transmitted to the brake operating means 13. Receiving this operation signal, the brake operating means 13 outputs the brake operating command 55 to operate the brake 50. Further, when the car speed information 35 exceeds the second overspeed detection level 126, an operation signal is transmitted to the emergency stop operating means 14. Receiving this operation signal, the emergency stop operating means 14 outputs the emergency stop operating command 65 to operate the emergency stop 60.

Figure 2:
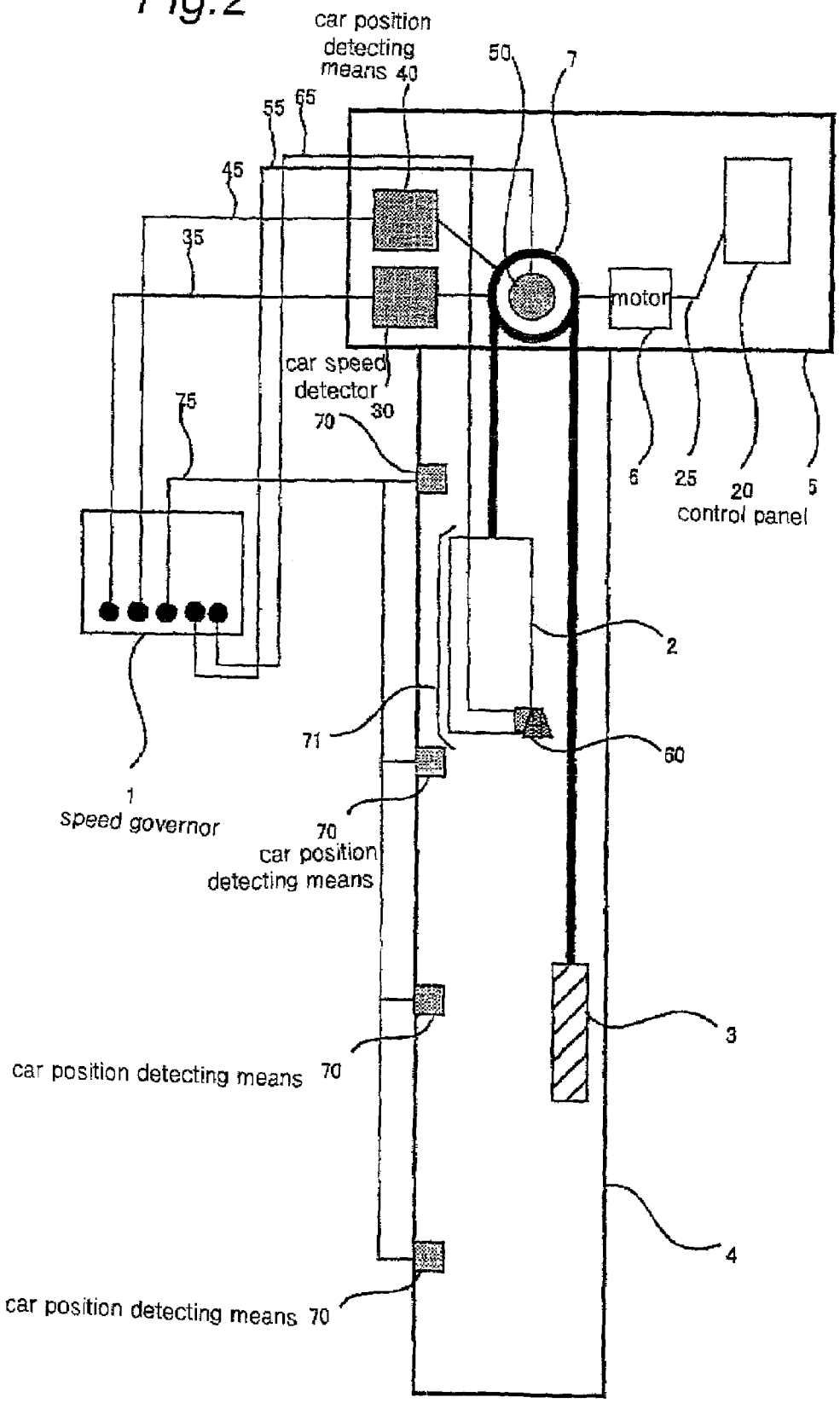
FIG. 2 is a diagram schematically and functionally showing a connection of the elevator apparatus of the first embodiment to other apparatuses.

FIG. 2 is a structural diagram of the first embodiment. In this drawing, each numeral given to a circuit portion connecting between components indicates information transmitted via the circuit portion. Specifically, the elevator apparatus has a car 2, a balance weight 3, an elevator shaft 4, a machine housing 5, a motor 6, and a sheave 7 of a winding machine. This allows that the sheave 7 is rotated by the driving of the motor 6 in the machine housing 5 so that the car 2 and the balance weight 3 connected to both end portions of a wire hung on this sheave 7 move up and down. Next, reference numeral 20 indicates a control panel, reference numeral 25 indicates operation command information, which includes information such as an operation speed command value and a destination floor (a floor designated by a call button), and reference numeral 71 indicates a shielding plate. A speed governor 1 for an elevator is electrically connected to a car speed detecting means 30, a car position detecting means 40, a brake 50 for a winding machine, an emergency stop 60 and a car position detecting means 70.

Specific examples of the conceivable car position detecting means 40 for detecting a position of the car 2 to be used in the elevator shaft 4 include a combination of a speed detection motor which detects a rotational speed of the sheave 7 and an arithmetic processing apparatus which converts the rotational speed into position information, an encoder for detecting the number of revolutions of the sheave or the like.

The car position detecting means 70 is installed in the elevator shaft 4. By a contact of the car position detecting means 70 with the shielding plate 71 installed at the car 2, for example, a switch of the position detecting means 70 is kicked up, whereby the position detecting means 70 can detect that the car 2 has passed an installation position of the car position detecting means 70. The element that operates the car position detecting means 70 is not limited to the shielding plate 71, for example. A switch-like material that operates the car position detecting means 70 may be used. In place of the car position detecting means 70 and the means 71 for operating the car position detecting means 70, car position information 75 may be obtained using a landing relay guidance plate usually installed in the vicinity of each floor, and a landing relay installed in the car. Alternatively, terminal switches usually installed in the vicinity of terminal floors may be used. Furthermore, the car position detecting means 70 may be installed in the car, while the means 71 for operating the car position detecting means 70 may be installed in the elevator shaft.

The car speed detecting means 30 may be a speed detection motor which measures a rotational speed of the sheave 7, or a combination of an encoder for detecting the number of revolutions of the sheave 7 and an arithmetic processing apparatus for converting the rotational number into position information. The speed governor 1 may be installed in the elevator shaft 4, the machine housing 5 or the car 2.

Next, the operation of the speed governor in the elevator apparatus will be described. The speed governor 1 obtains the car speed information 35 from the car speed detecting means 30. Further, the speed governor 1 continuously obtains car position information 45 determined from the rotation of the sheave 7 by the car position detecting means 40, while the speed governor 1 intermittently obtains, from the car position detecting means 70, the car position information 75 conveying that the car 2 has passed the installation position of the car position detection means 70. The speed governor 1, which has received these information, corrects the continuous car position information 45 based on the intermittent car position information 75 to obtain post-correction car position information 85. Subsequently, the speed governor 1 compares each of overspeed detection levels (a first overspeed level and a second overspeed level), which are criteria determined on the basis of the post-correction car position information 85, with a car speed corresponding to the car position information 35 to determine whether the car speed exceeds the first overspeed detection level 125 or the second overspeed detection level 126. Together with that, in the case where its overspeed exceeds any one of the overspeed detection levels, its excess amount (overspeed) is detected. If the overspeed is detected, the brake 50 or the emergency stop 60 is operated depending on the extent of the overspeed. Therefore, for example, if the position detecting means 70 is installed on the side of a space where the car 2 is not allowed to enter (specifically, a space allowed for a terminal floor), and the second overspeed detection level in the space allowed for the terminal floor is set to 0 (m/min) in advance, the car 2 enters the terminal floor at a high speed not rushing in a lower end pit or an upper end overhead space of the elevator shaft.

In this manner, the car position detecting means 40, which is constructed of the combination of the speed detection motor for detecting the rotational speed of the sheave and the arithmetic processing apparatus for converting the rotational speed into the position information, or the encoder for detecting the number of revolutions of the sheave 7 and so on, can continuously detect a car position. However, it does not detect an actual position of the car and thus it is considered that an error due to various factors such as elongation of a rope or an influence of slippage between the rope and the sheave occurs. On the other hand, the car position detecting means 70 has the advantage of being free of measurement errors and so on because of the following reason. The car position detecting means 70 travels with the elevator shaft 4 in accordance with expansion and contraction of the elevator shaft 4, and is thereby always located at the same, fixed position in the elevator shaft 4. The car position detecting means 70 performs position detection by a direct contact of the car without any influence of the expansion and contraction of the elevator shaft 4. As the disadvantage, not being able to perform continuous car position detection is given. Thus, according to the embodiment of the present invention wherein the car position detecting means 40 that can perform continuous car position detection, and the car position detecting means 70 that can perform actual car position detection in the elevator shaft, though intermittently, are used, car position information obtained by the car position detecting means 40 can be corrected by the car position detecting means 70.

Figure 3:
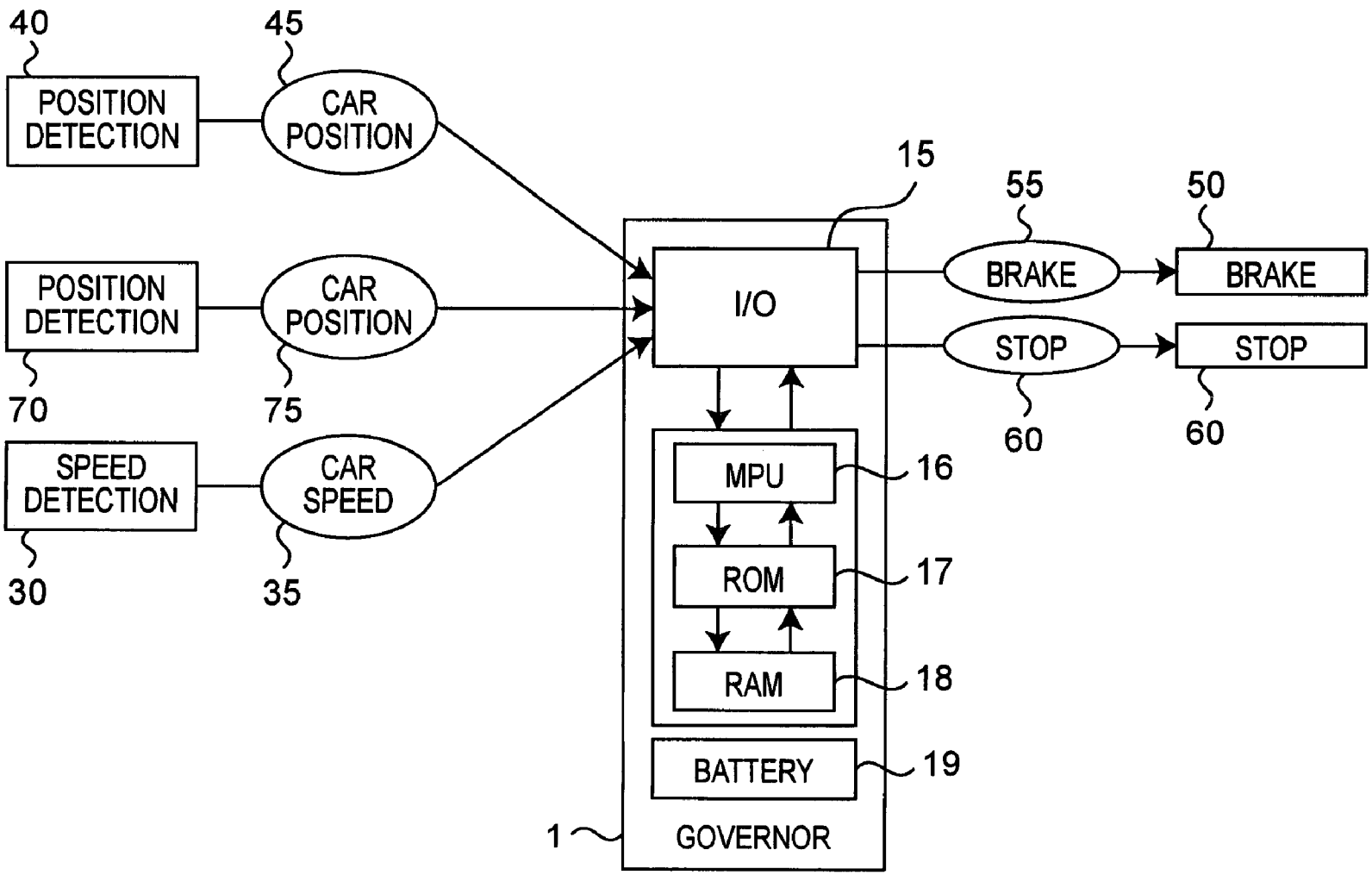
FIG. 3 is a diagram schematically and functionally showing one example of the elevator apparatus of the first embodiment.

FIG. 3 is a diagram showing one specific example of the construction of a speed governor 1 for an elevator shown in FIGS. 1 and 2. In this diagram, reference numeral 15 indicates an I/O port, which inputs car speed information 35, car position information 45 and car position information 75 to the speed governor 1, and which outputs an operation signal to a brake 50 for a winding machine or an emergency stop 60, reference numeral 16 indicates a microprocessor which corrects the car position information 45 on the basis of the car position information 45 and the car position information 75, rewrites corresponding data stored in a ROM to a corrected value, and detects an overspeed to output a signal for operating the brake 50 or the emergency stop 60, reference numeral 17 indicates the ROM which stores an overspeed detecting program, a first overspeed detection level, and a second overspeed detection level, reference numeral 18 indicates a RAM which temporarily stores car speed information and car position information, reference numeral 19 indicates a battery which supply the speed governor 1 with power when power supply from the outside stops. The I/O port 15, the microprocessor 16, the ROM 17, the RAM 18 and the battery 19 are electrically connected to achieve the following function.

Next, the operation will be described. If the microprocessor 16 obtains the car speed information 35, the car position information 45, and the car position information 75 via the I/O port 15, it determines whether the car 2 is in a state of overspeed travel using the overspeed detecting program stored in the ROM. For example, the overspeed detecting program detects a difference between the continuous car position information 45 and the intermittent car position information 75 and corrects the car position information 45 on the basis of the car position information 75 to obtain post-correction car position information 85. Next, on the basis of the car position information 45 and the car position information 75, the first overspeed detection level and the second overspeed detection level stored in the ROM are corrected. Subsequently, the first overspeed detection level and the second overspeed detection level that correspond to the car position information 85 are compared with the car speed information 35. When the car speed information 35 exceeds the first overspeed detection level, a signal 55 that operates the brake 50 is outputted, while, when the car speed information 35 exceeds the second overspeed detection level, a signal 65 that operates the emergency stop 60 is outputted. These signals 55, 65 are outputted through the I/O port 15, so that the brake 50 or the emergency stop 60 is operated.

Figure 6:
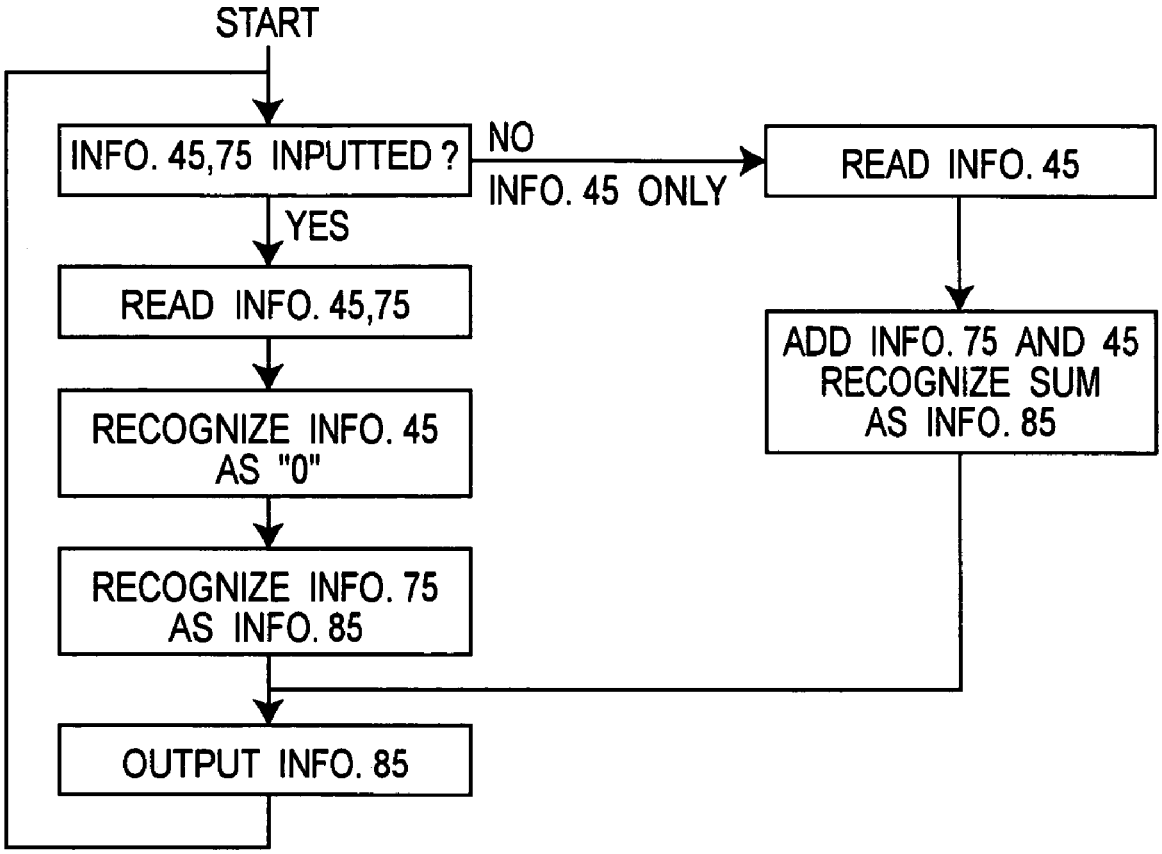
FIG. 6 is a flowchart showing a process for obtaining a corrected value of car position information.

One example of a correcting method in a position information correcting means 80 will be described using a flowchart of FIG. 6. First, the car position detecting means 40 can perform continuous car position detection, while the car position detecting means 70 cannot perform continuous car position detection. Therefore, in the position information correcting means 80, it is determined whether inputs of both of the car position information 45 and the car position information 75 are inputted. If there are inputs of both of them, a value of the car position information 45 is set to "0". Recognizing the car position information 75 as an actual position of the car, the position information correcting means 80 outputs the car position information 75 as the car position information 85. If there is no input of the car position information 75, namely, if there is an input of only the car position information 45, the car position information 45 represents a traveled distance of the car since the previous input of the car position information 75. Recognizing a value obtained by adding the car position information 45 to the previous car position information 75 as the actual position of the car, the position information correcting means 80 outputs the value as the car position information 85. By repeating the above process, each time the car passes an installation position of the car position detecting means 70, an error of the car position information 45 is reset.

According to the first embodiment as described above, the car position information 45, which is continuously obtained by the rotation of the sheave 7, can automatically be corrected on the basis of the car position information 75 showing the actual position of the car, which is obtained from the car position detecting means 70 installed in the elevator shaft 4. Therefore, adjustment work in installing the speed governor for the elevator in the construction site becomes unnecessary. Since there is no influence on the elevator apparatus due to the change with time (elongation of the wire etc.), the long time maintenance becomes unnecessary. Furthermore, since the overspeed detection levels can be changed in accordance with the position of the car, it is possible to detect the overspeed using, for example, the overspeed detection levels corresponding to the acceleration/deceleration pattern in the vicinity of the terminal floors and the rated speed.

Embodiment 2

Figure 7:
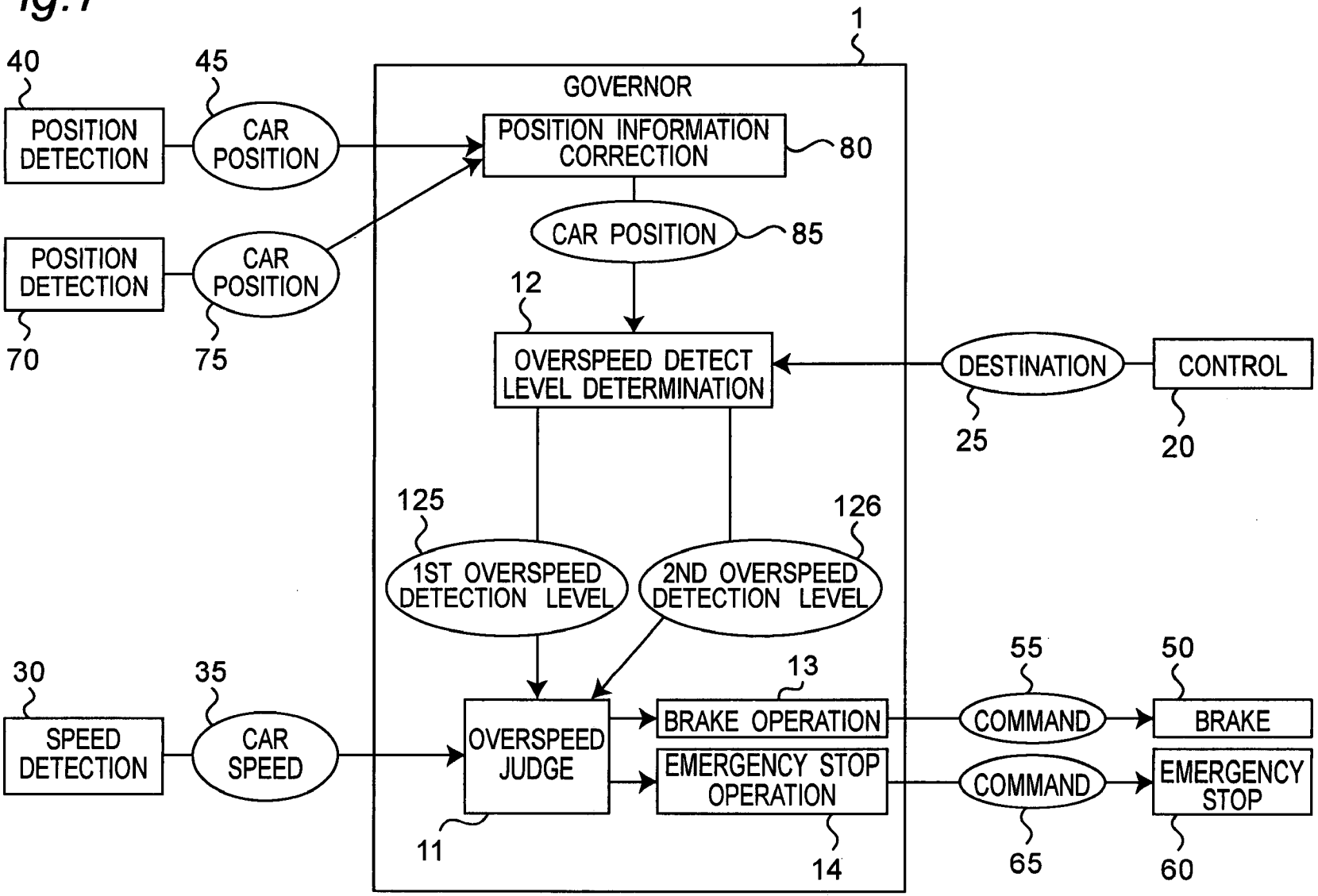
FIG. 7 is a diagram schematically and functionally showing the construction of an elevator apparatus according to a second embodiment.
Figure 8:
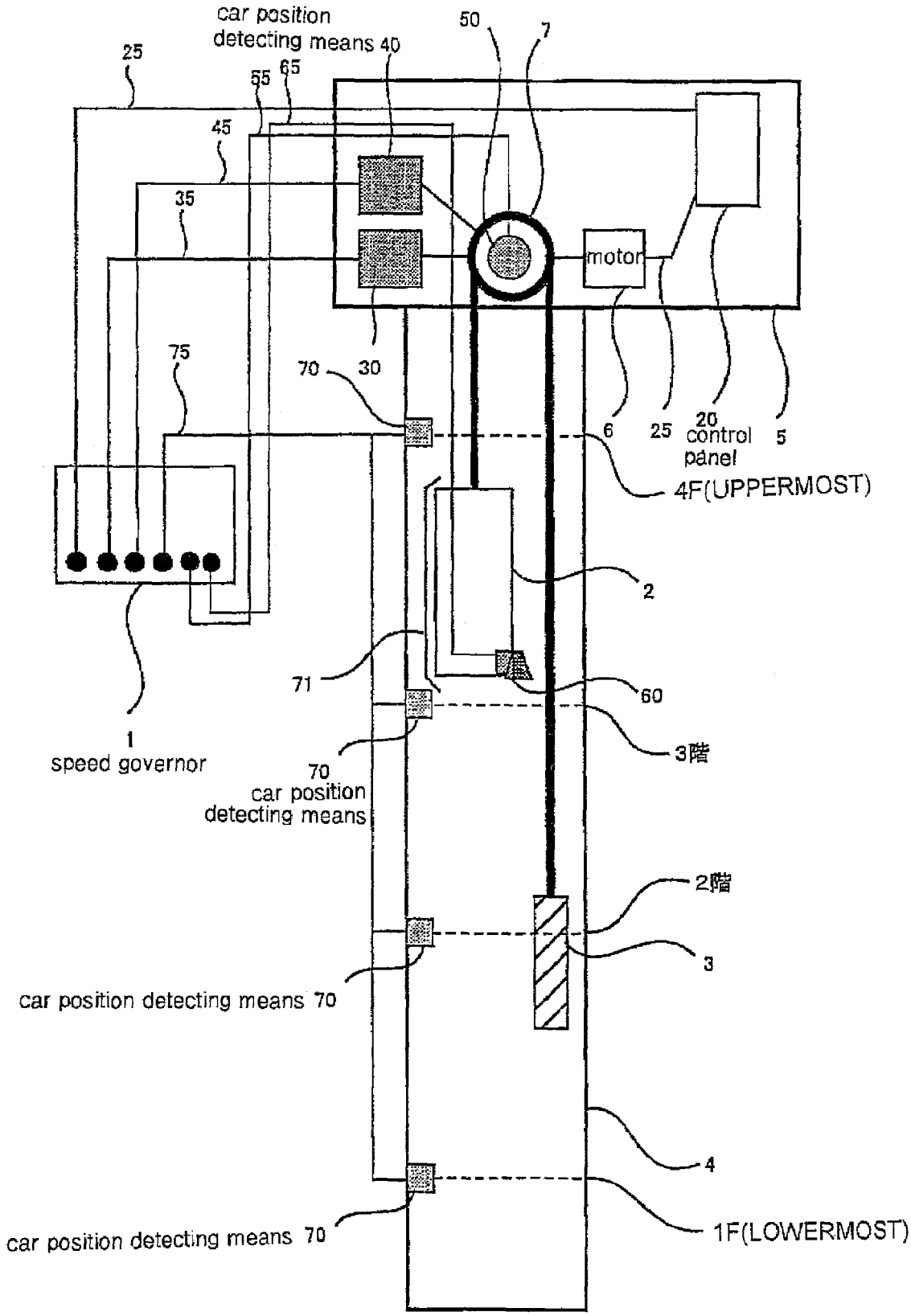
FIG. 8 is a diagram schematically and functionally showing a connection of the elevator apparatus of the second embodiment to other apparatuses.

FIG. 7 and FIG. 8 are diagrams each showing the construction of an elevator apparatus of the second embodiment of the invention. In a speed governor 1 for an elevator of this elevator apparatus, a control panel 20 transmits operation command information 25 to an overspeed detection level determining means 12. Obtaining the operation command information 25, the overspeed detection level determining means 12 determines a first overspeed detection level 125 and a second overspeed detection level 126 on the basis of the distance to a destination floor obtained from car position information 85 and destination information of a car included in the operation command information 25.

Figure 9:
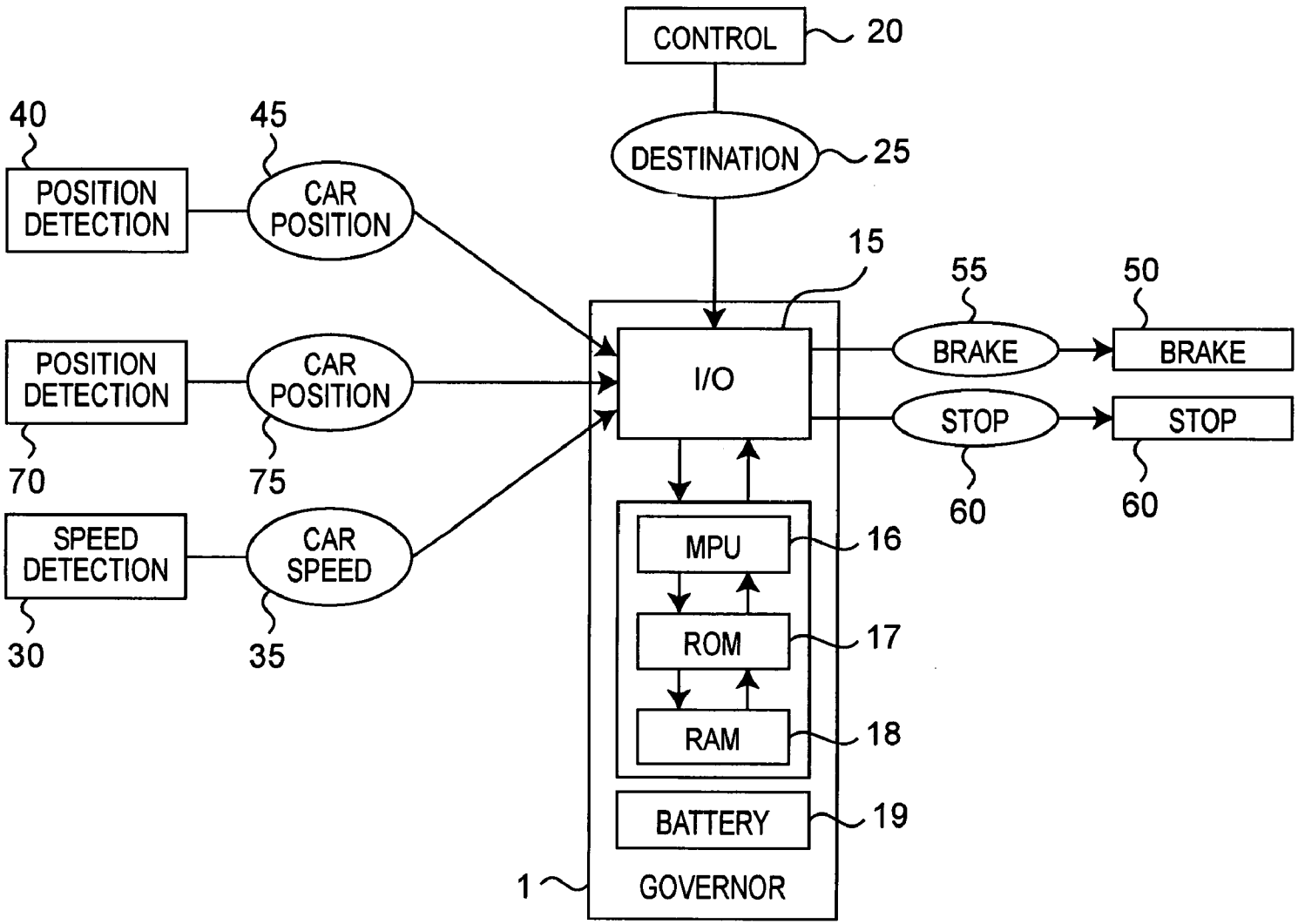
FIG. 9 is a diagram schematically and functionally showing one example of the elevator apparatus of the second embodiment.

With reference to FIG. 9, signal processing in the speed governor 1 will be described in further detail. First, an I/O port 15 inputs the operation command information 25 including the destination information of the car, car speed information 35, car position information 45 and car position information 75 to the speed governor 1, and outputs an operation signal to a brake 50 for a winding machine or an emergency stop 60. A microprocessor 16 corrects displacement using the car position information 45 and the car position information 75, rewrites data of a ROM 17 with accompanying correction of the displacement, detects an overspeed and outputs a signal which operates the brake for the winding machine or the emergency stop.

Figure 10:
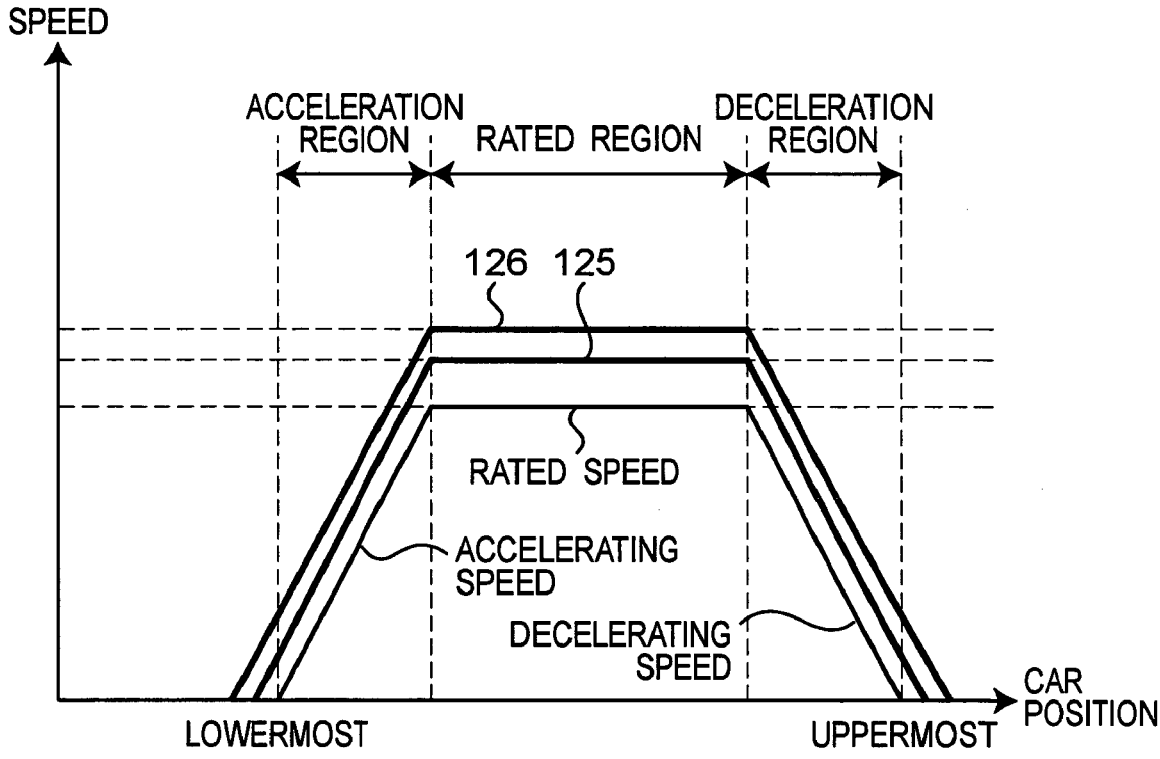
FIG. 10 is a drawing of a graph showing a relationship between a travel speed of a car and both a first and a second overspeed.

In the above-described second embodiment, the first overspeed detection level 125 and the second overspeed detection level 126 are determined by the car position information 85 in the same manner as in the first embodiment. However, in Embodiment 2, the destination information (destination floor) of the car is inputted to the overspeed detection level determining means 12 from the control panel 20 in addition to the car position information 85. Thus, the distance from the starting floor of the car to the destination floor at which there was a call can be recognized. Then, as shown in FIG. 10, in the travel from the starting floor to the destination floor of the car, the first overspeed detection level 125 and the second overspeed detection level 126 are outputted. The destination information of the car may be changed during the travel of the car from the inside or outside of the car. In order to cope with that, new destination information is inputted to the overspeed detection level determining means 12 to update the overspeed detection levels 125, 126 each time the destination information of the car is changed. Then, the car position information 45, which is continuously obtained by the rotation of a sheave 7, can automatically be corrected on the basis of the car position information 75 indicating an actual position of the car, which is obtained from a car position detecting means 70 installed in an elevator shaft 4. Therefore, the same effect as that obtained in the first embodiment can be obtained.

Embodiment 3

Figure 11:
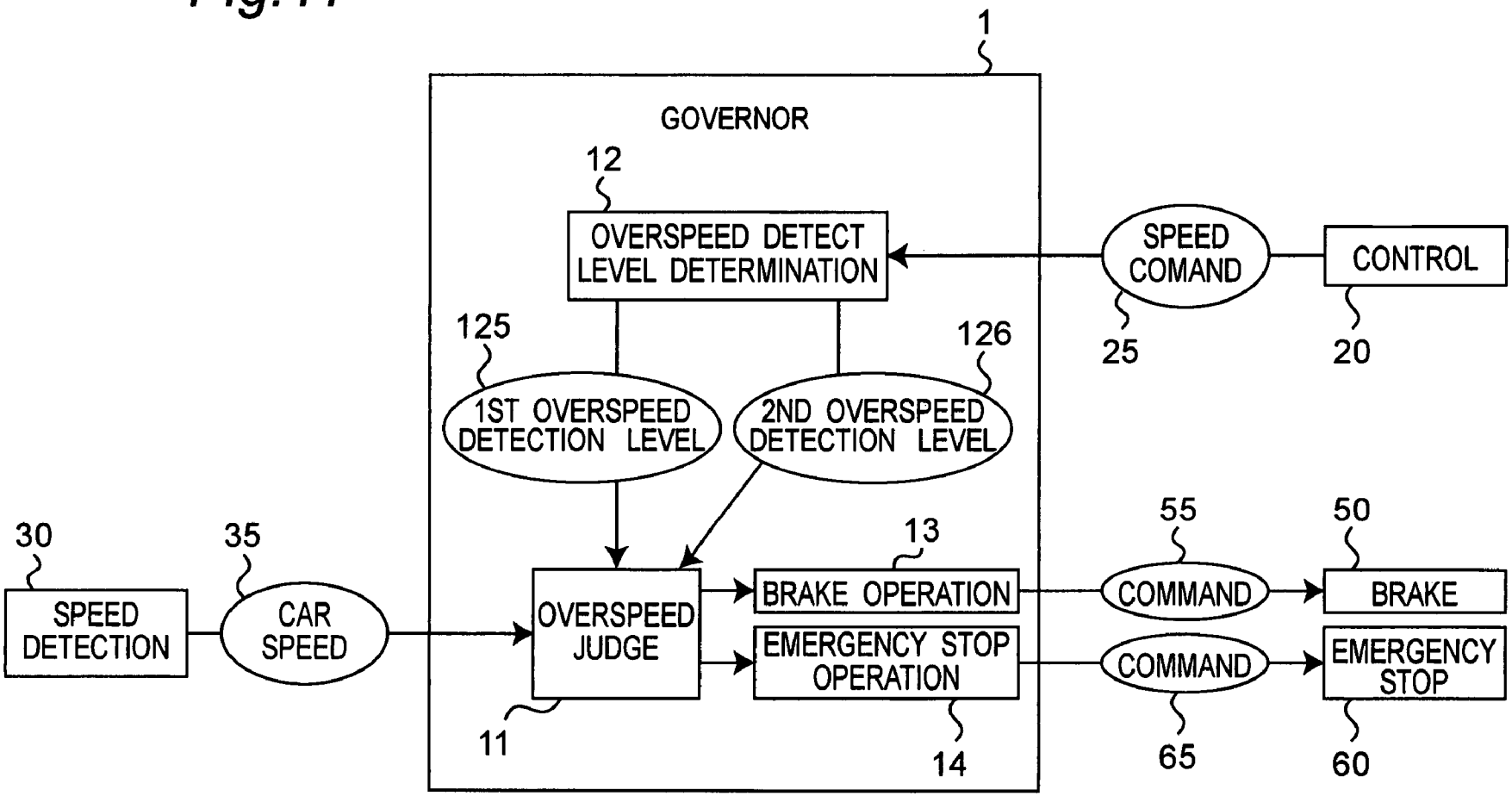
FIG. 11 is a diagram schematically and functionally showing the construction of an elevator apparatus according to a third embodiment.
Figure 12:
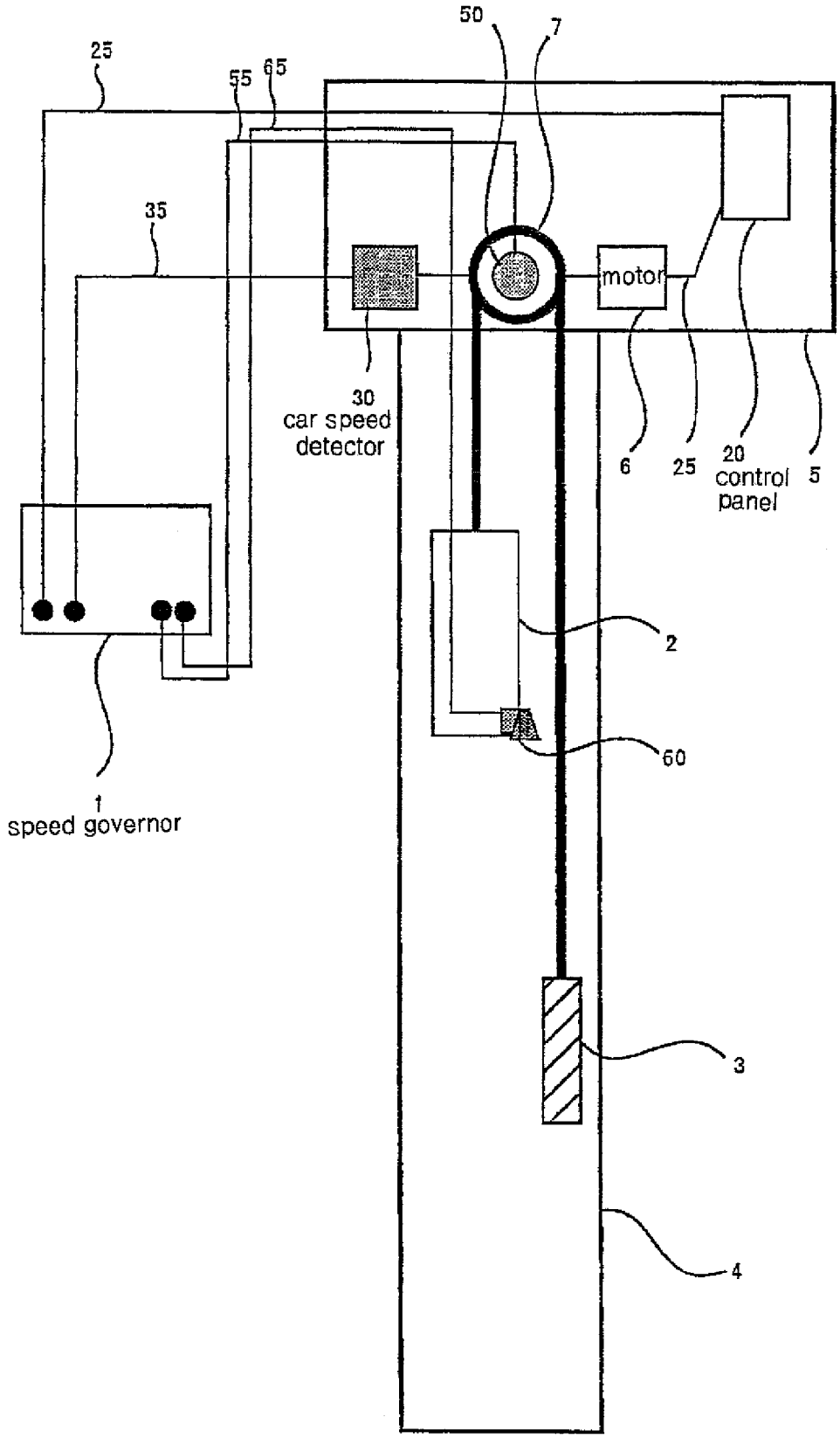
FIG. 12 is a diagram schematically and functionally showing a connection of the elevator apparatus of the third embodiment to other apparatuses.

FIG. 11 and FIG. 12 are diagrams each schematically and functionally showing the construction of an elevator apparatus of a third embodiment of the present invention. In a speed governor 1 for an elevator, a control panel 20 transmits operation command information 25 to an overspeed detection level determining means 12. Obtaining the operation command information 25; the overspeed detection level determining means 12 determines a first overspeed detection level 125 and a second overspeed detection level 126 on the basis of car position information 85 and an operation speed command value included in the operation command information 25.

Figure 13:
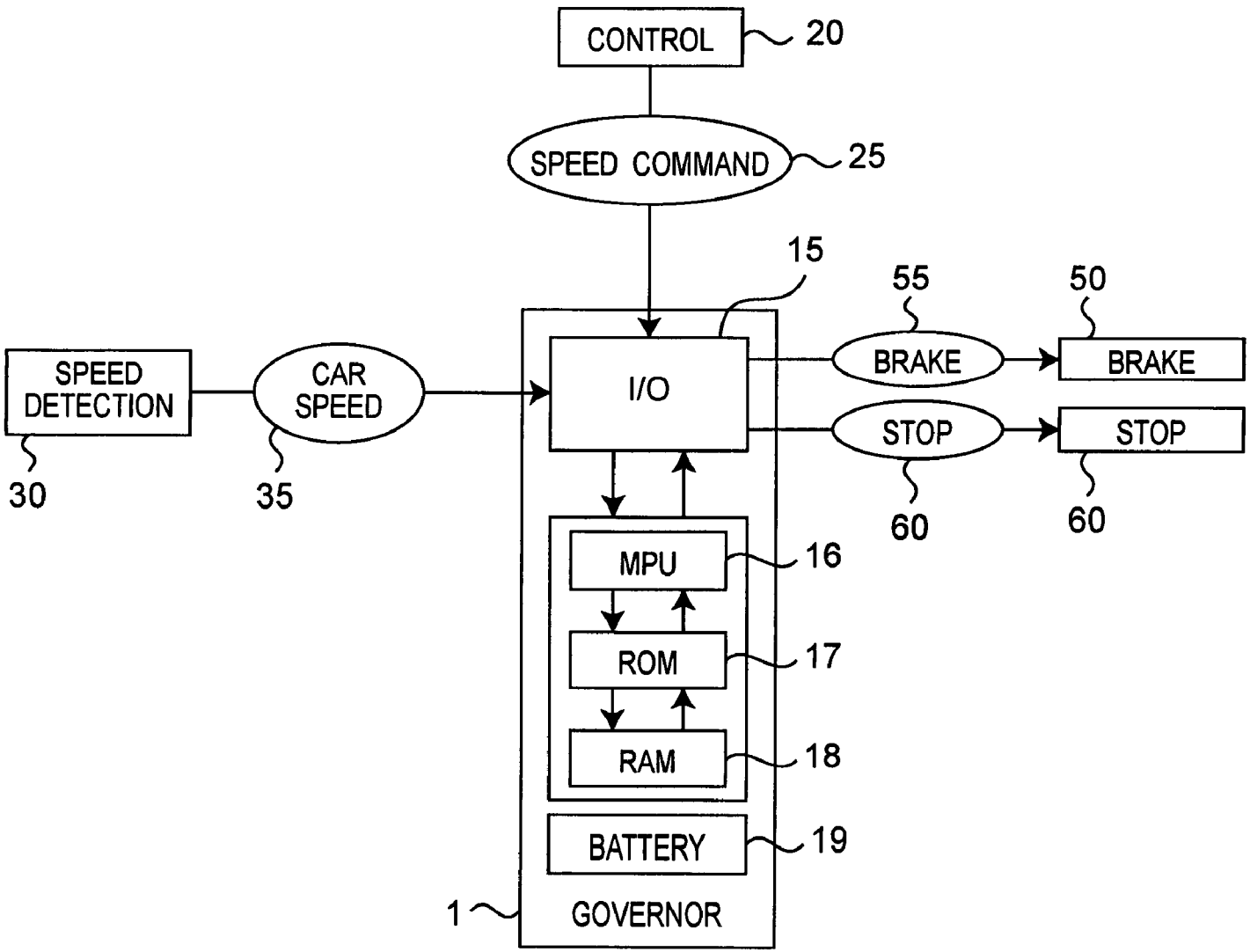
FIG. 13 is a diagram schematically and functionally showing one example of the elevator apparatus of the third embodiment.

With reference to FIG. 13, signal processing in the speed governor 1 will be described in further detail. First, an I/O port 15 inputs the operation command information 25 including the operation speed command value, car speed information 35, car position information 45 and car position information 75 to the speed governor 1, and outputs an operation signal to a brake 50 for a winding machine or an emergency stop 60. A microprocessor 16 corrects displacement using the car position information 45 and the car position information 75, rewrites data of a ROM 17 with accompanying correction of the dislocation, detects an overspeed and outputs a signal which operates the brake for the winding machine or the emergency stop.

Figure 14:
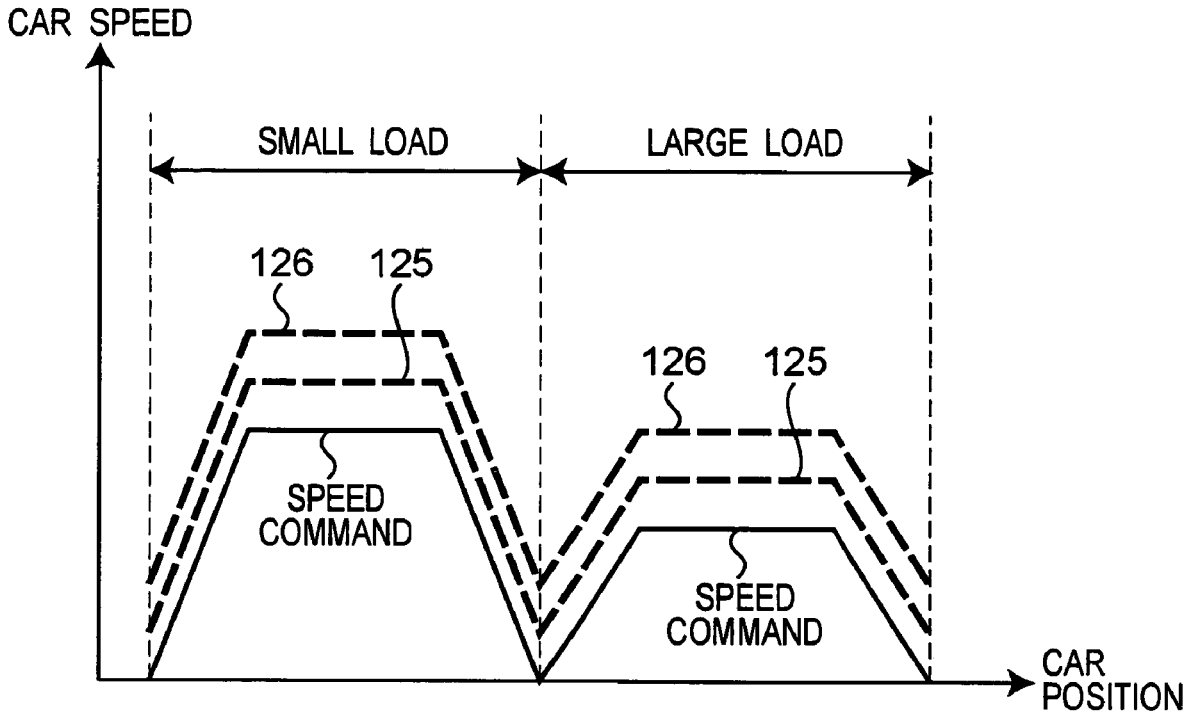
FIG. 14 is a drawing of a graph showing a relationship between a travel speed of a car and both a first and a second overspeed.
Figure 15A:
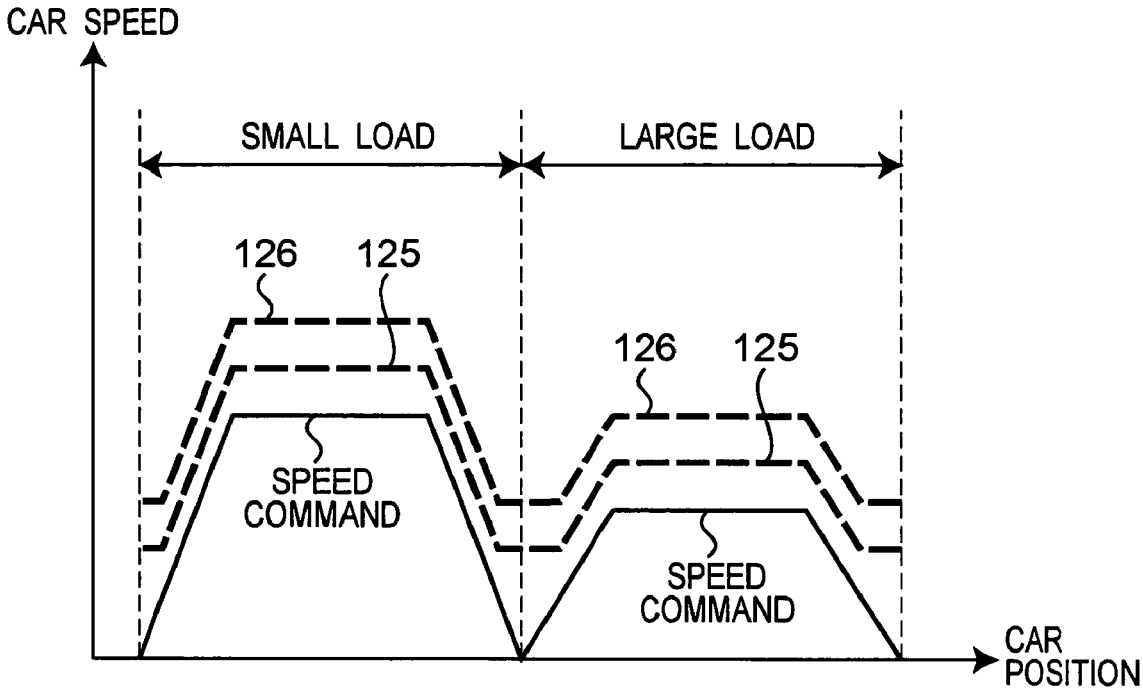
FIGS. 15A and 15B are graphs showing a relationship between a travel speed of a car and both a first and a second overspeed.
Figure 15B:
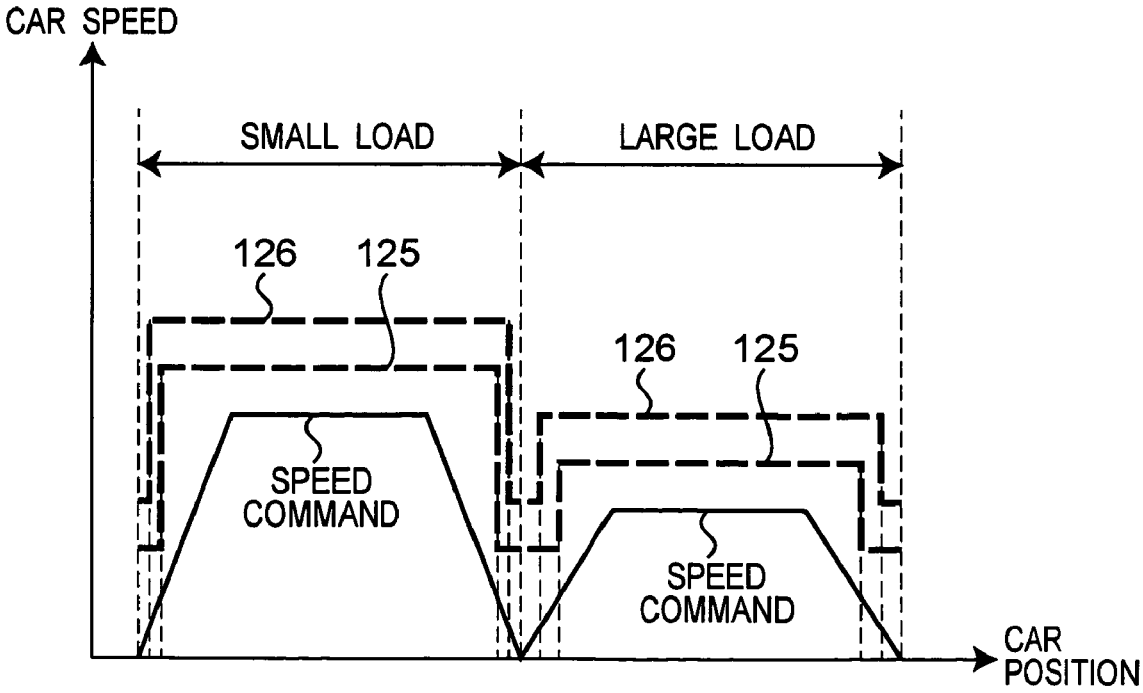

Therefore, according to the third embodiment of the present invention, in addition to the effect obtained in the first embodiment, for example, as shown in FIG. 14, it becomes possible to carry out overspeed detection also in an elevator that adopts an operation method in which it travels at a high speed when a load is large, while it travels at a low speed when a load is small, supposing that it travels an equal distance. Further, the patterns of the first overspeed detection level 125 and the second overspeed detection level 126 are not limited to trapezoidal patterns. As shown in FIG. 15A, if an operation speed command value is lower than a predetermined value, the operation speed command value may be constant, and, after exceeding this predetermined value, it may be linearly varied or varied stepwise as shown in FIG. 15B.

Embodiment 4

Figure 16:
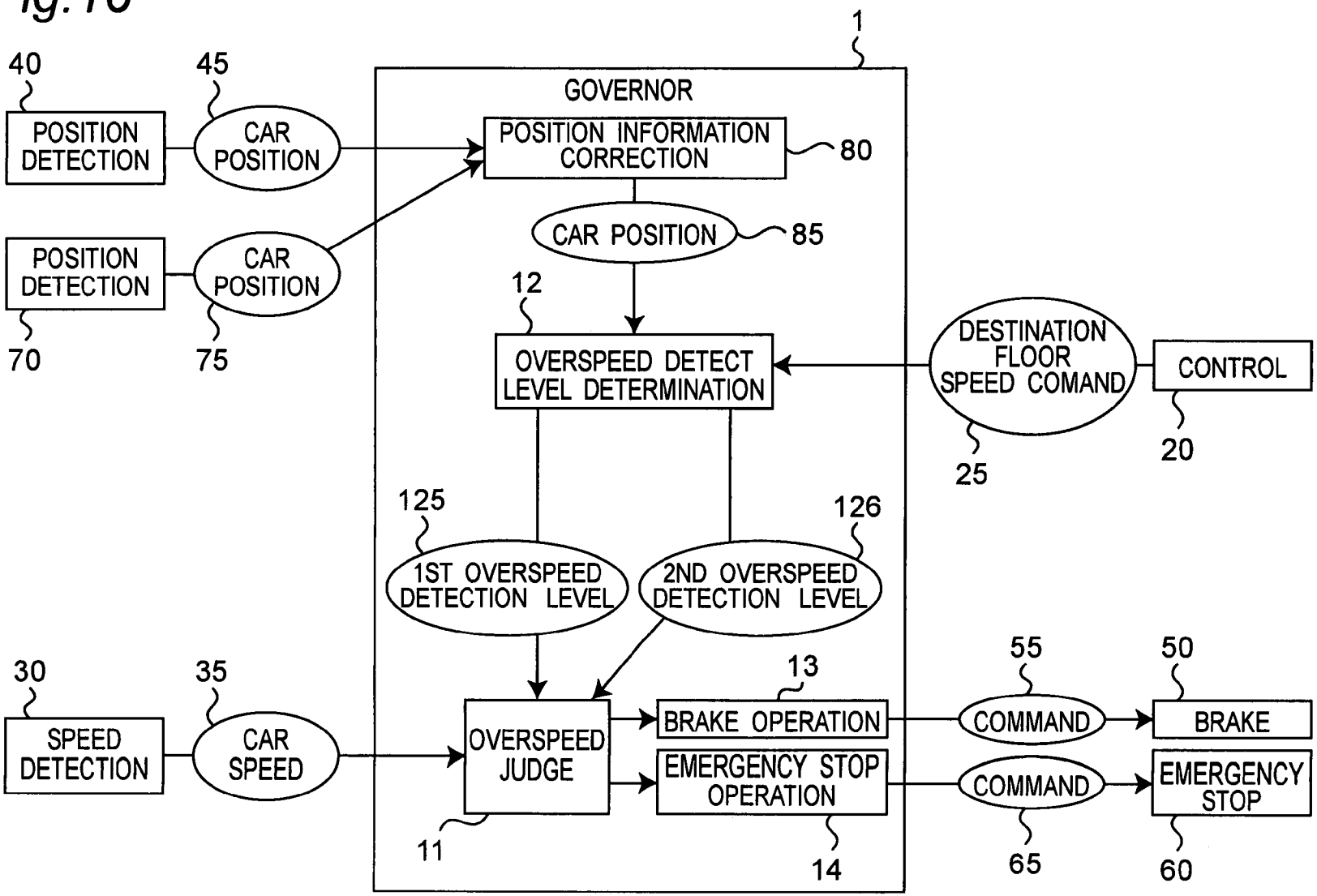
FIG. 16 is a diagram schematically and functionally showing the construction of an elevator apparatus according to a fourth embodiment.

FIG. 16 is a diagram schematically and functionally showing the construction of an elevator apparatus of the second embodiment of the present invention. In a speed governor 1 for an elevator of this elevator apparatus, a control panel 20 transmits operation command information 25 to an overspeed detection level determining means 12. Obtaining the operation command information 25, the overspeed detection level determining means 12 determines a first overspeed detection level 125 and a second overspeed detection level 126 on the basis of both destination information of a car and an operation speed command value obtained from car position information 85 and the operation command information 25.

Figure 17:
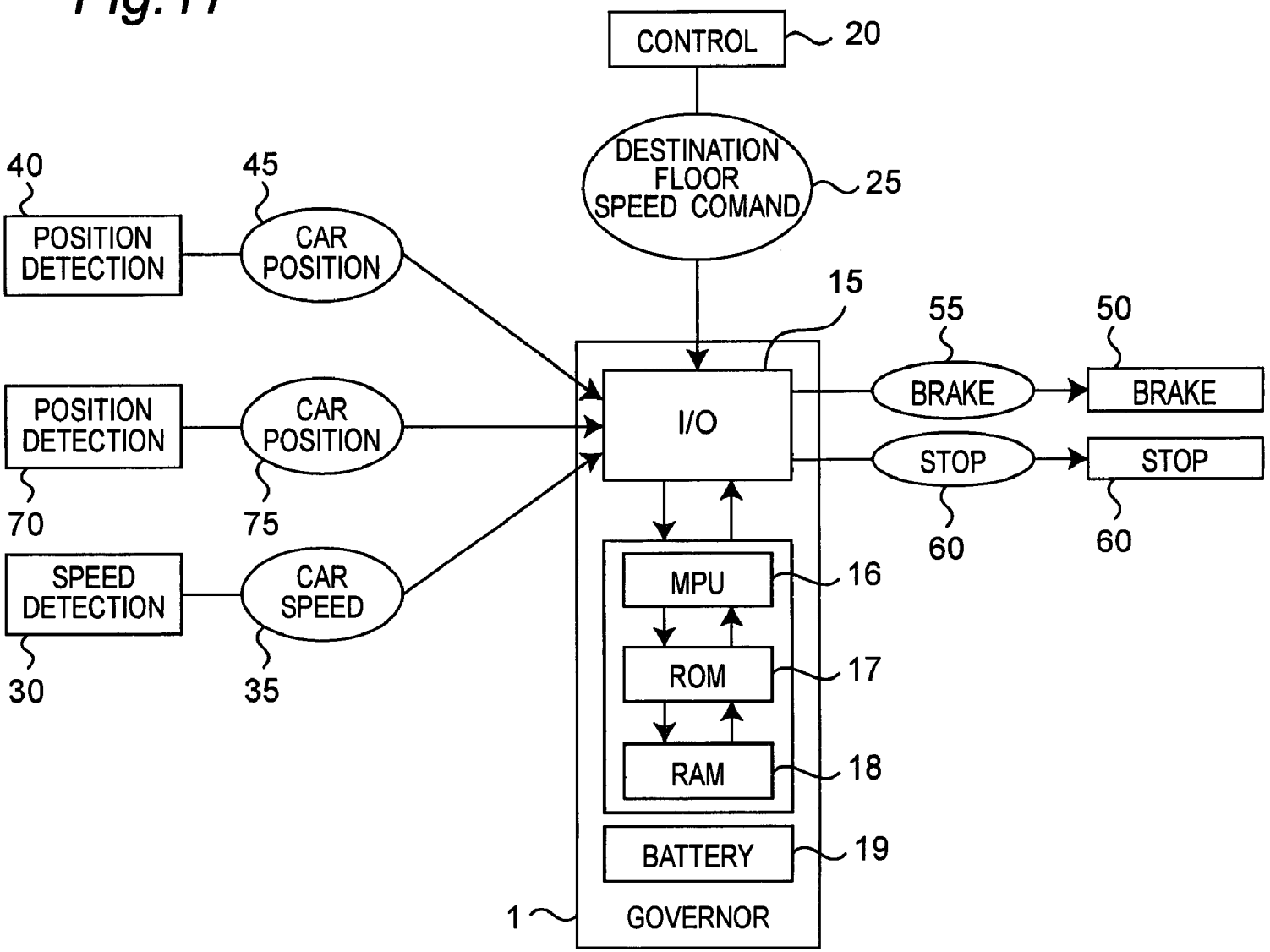
FIG. 17 is a diagram schematically and functionally showing one example of the elevator apparatus of the fourth embodiment.

With reference to FIG. 17, signal processing in the speed governor 1 will be described in further detail. First, an I/O port 15 inputs the destination information (the distance from a starting floor to a destination floor) and an operation speed command value 25, car speed information 35, car position information 45 and car position information 75 to the speed governor 1, and outputs an operation signal to a brake 50 for a winding machine or an emergency stop 60. A microprocessor 16 corrects displacement on the basis of the car position information 45 and the car position information 75, rewrites data of a ROM 17 with accompanying correction of the dislocation, detects an overspeed and outputs a signal which operates the brake for the winding machine or the emergency stop.

According to the fourth embodiment thus constructed, the overspeed detection levels are determined on the basis of the momentary car position information, the operation speed command value and so on, so that a speed governor for an elevator that can carry out safer overspeed detection is obtained. Furthermore, the first overspeed detection level 125 and the second overspeed detection level 126 can be determined from the destination information and the car position information. Alternatively, they can also be determined from the operation speed command. Furthermore, by selecting a safer value between them, namely, by selecting a value having a lower speed, the final first and second overspeed detection levels 125 and 126 may be determined. From the determination as above, it is possible to carry out overspeed detection that secures higher safety.

Embodiment 5

Figure 18:
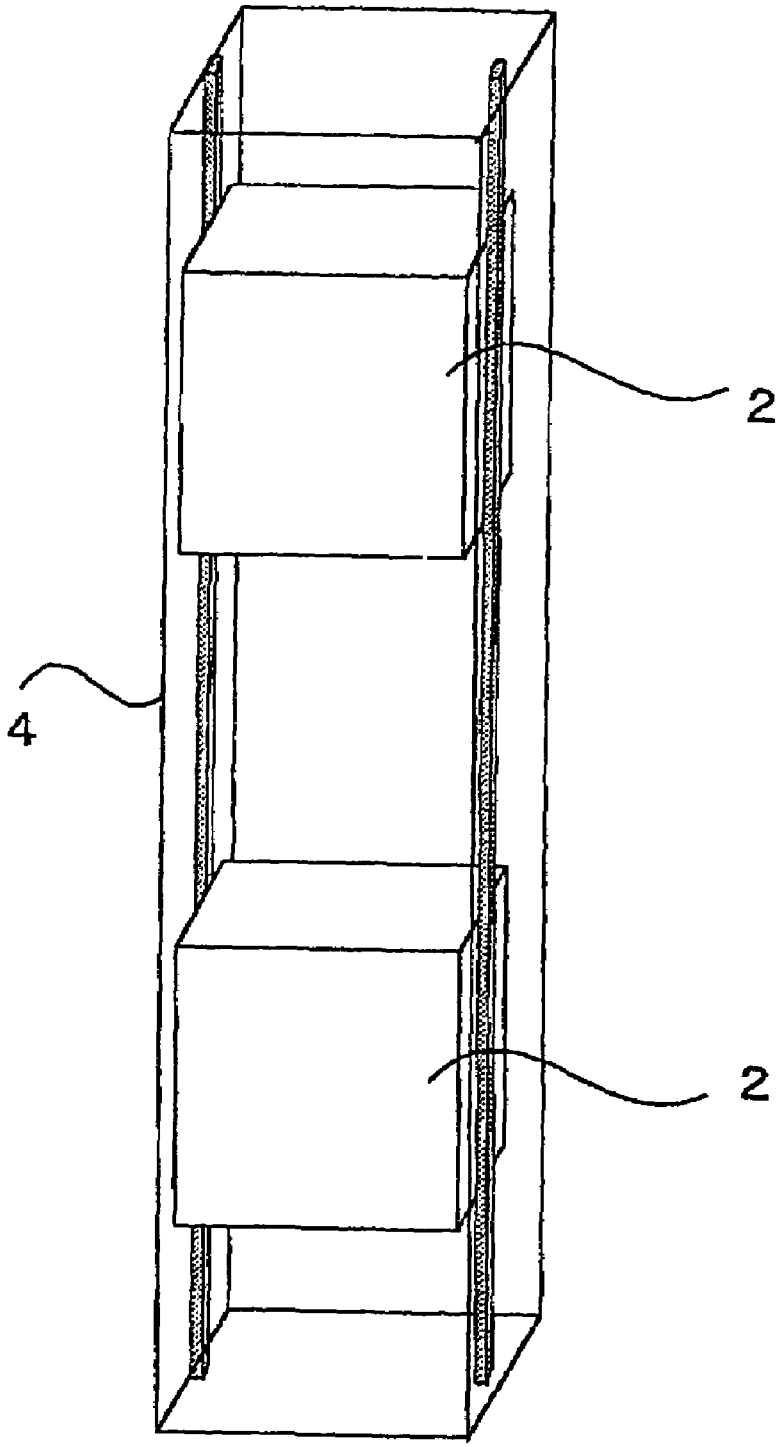
FIG. 18 is a perspective view showing the construction of a double-car elevator apparatus.
Figure 19:
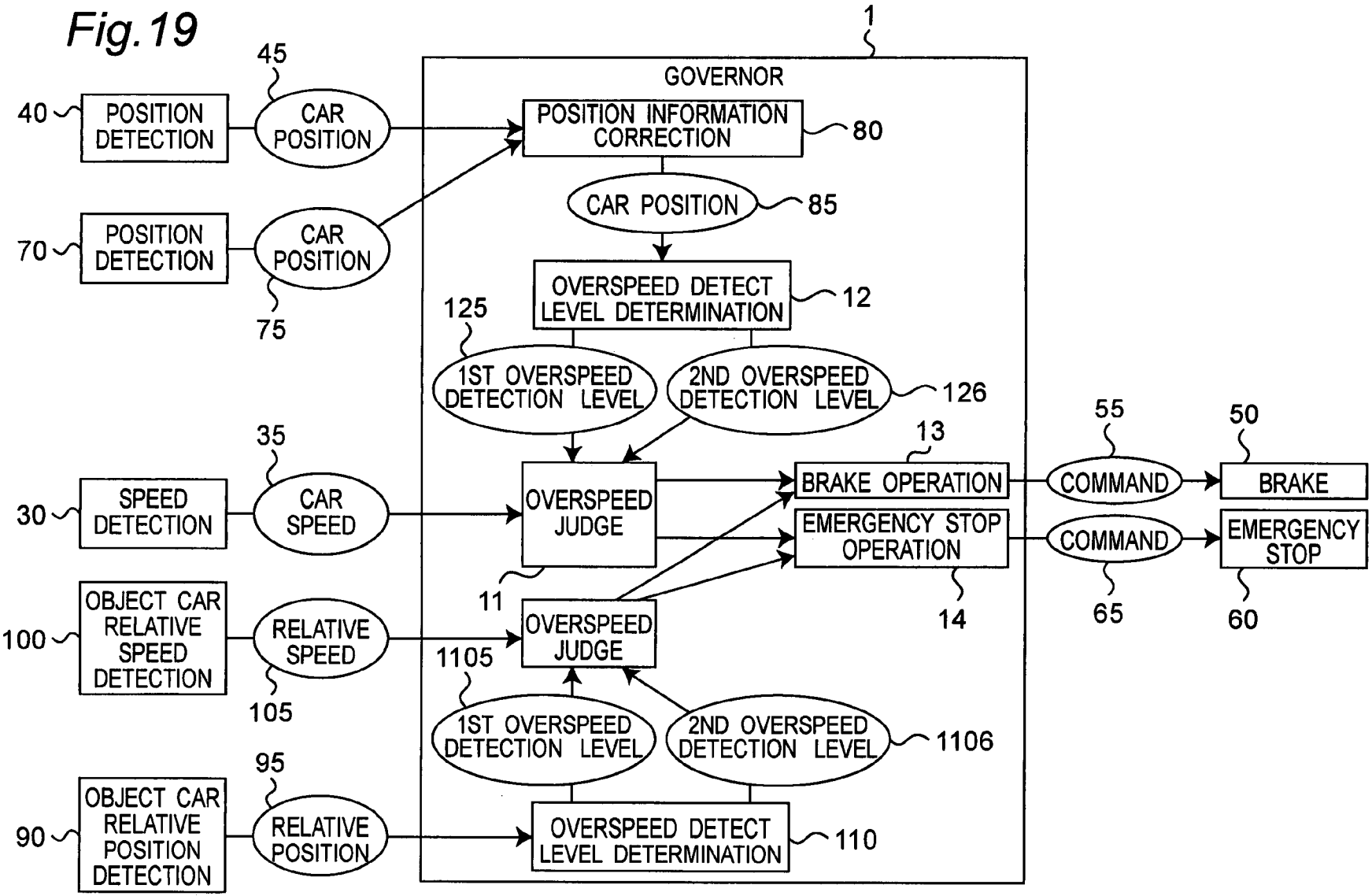
FIG. 19 is a diagram schematically and functionally showing the construction of a double-car elevator apparatus or a multi-car elevator apparatus.

In a fifth embodiment, the present invention is applied to a double-car elevator apparatus or a multi-car elevator apparatus. As shown in FIG. 18 and FIG. 19, the double-car elevator apparatus means an elevator apparatus in which two cars 2 travel in the same elevator shaft 4. The multi-car elevator apparatus means an elevator apparatus in which three or more cars 2 travel in the same elevator shaft 4. As a means for preventing collision between cars, using a speed governor for an elevator and an emergency stop is considered. Different from the embodiments 1-4, the double-car or multi-car elevator apparatus requires relative information with respect to an object car to the considered. Thus, in the double-car and multi-car apparatuses, an overspeed detection level determining means 12 receives car position information 85 and determines a first overspeed detection level 125 and a second overspeed detection level 126. Relative position information 95 with respect to the object car detected by a position detecting means 90 for the object car is inputted to an overspeed detection level determining means 110. The overspeed detection level determining means 110 determines and outputs a first overspeed detection level 1105 and a second overspeed detection level 1106 on the basis of the relative position information 95. A relative speed 105 with respect to that of the object car is detected by a relative speed (approaching speed) detecting means 100 for the object car. Next, the first overspeed detection level 1105, the second overspeed detection level 1106 and the relative speed 105 are inputted to an overspeed travel judging means 120 and their levels are compared. When the relative speed 105 is higher than the first overspeed detection level 1105, the overspeed travel judging means 120 conveys this to a brake operating means 13 for a winding machine. Then, the brake operating means 13 outputs a brake operation command 55 to operate a brake 50 for the winding machine. When the relative speed 105 is higher than the second overspeed detection level 1106, the overspeed travel judging means 120 conveys this to an emergency stop operating means 14. Then, the emergency stop operating means 14 outputs an emergency stop operation command 65 to operate an emergency stop 60.

The relative position detecting means 90 and the relative speed detecting means 100 that are conceivable include a non-contact position detector, such as a milliwave rader type position sensor, an ultrasonic position sensor and a semiconductor rader type position sensor, a means for calculating a distance from car position information detected by the car position detecting means to an object car and so on.

Embodiment 6

Figure 20:
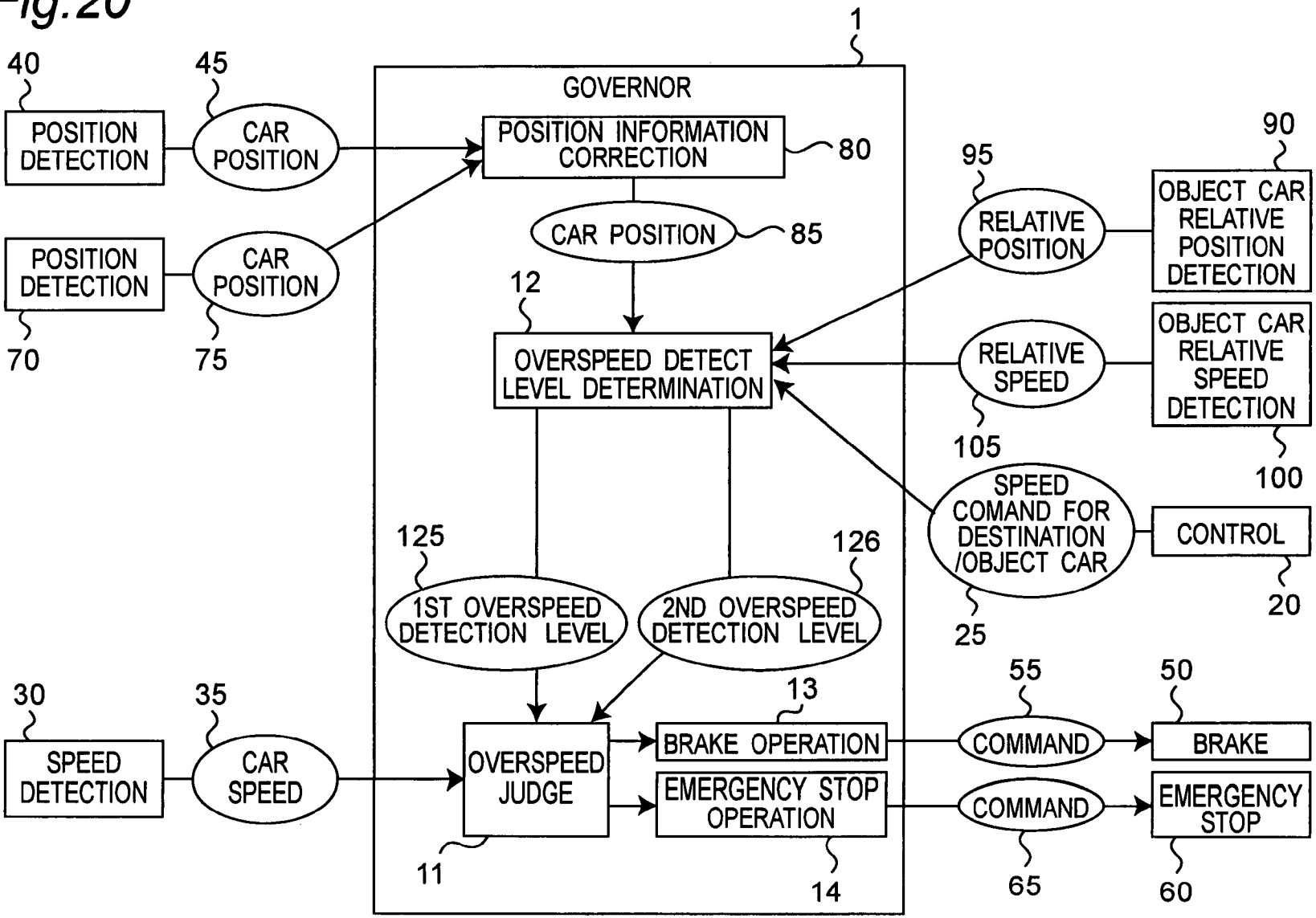
FIG. 20 is a diagram schematically and functionally showing the construction of a double-car elevator apparatus or a multi-car elevator apparatus.
Figure 21:
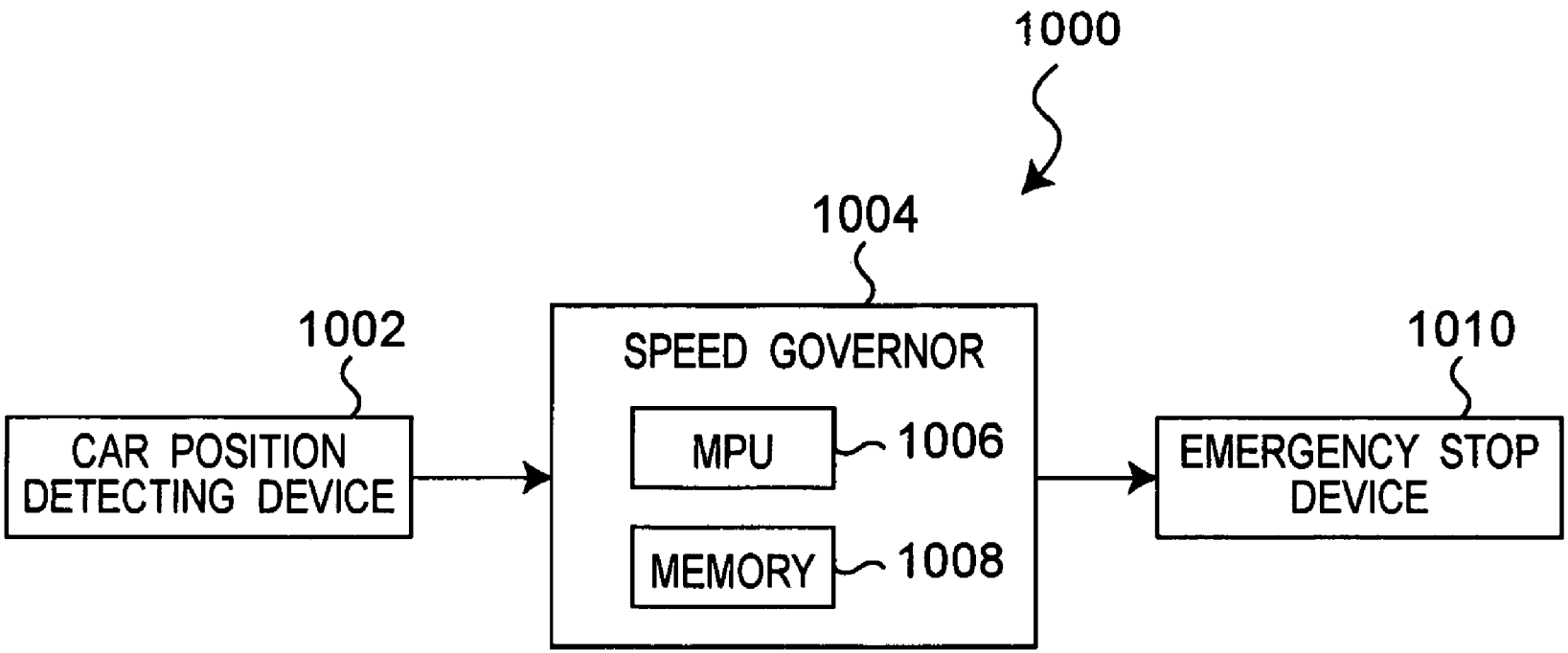
Fig.21 PRIOR ART
FIG. 21 is a schematic diagram of a conventional elevator apparatus.
Figure 22:
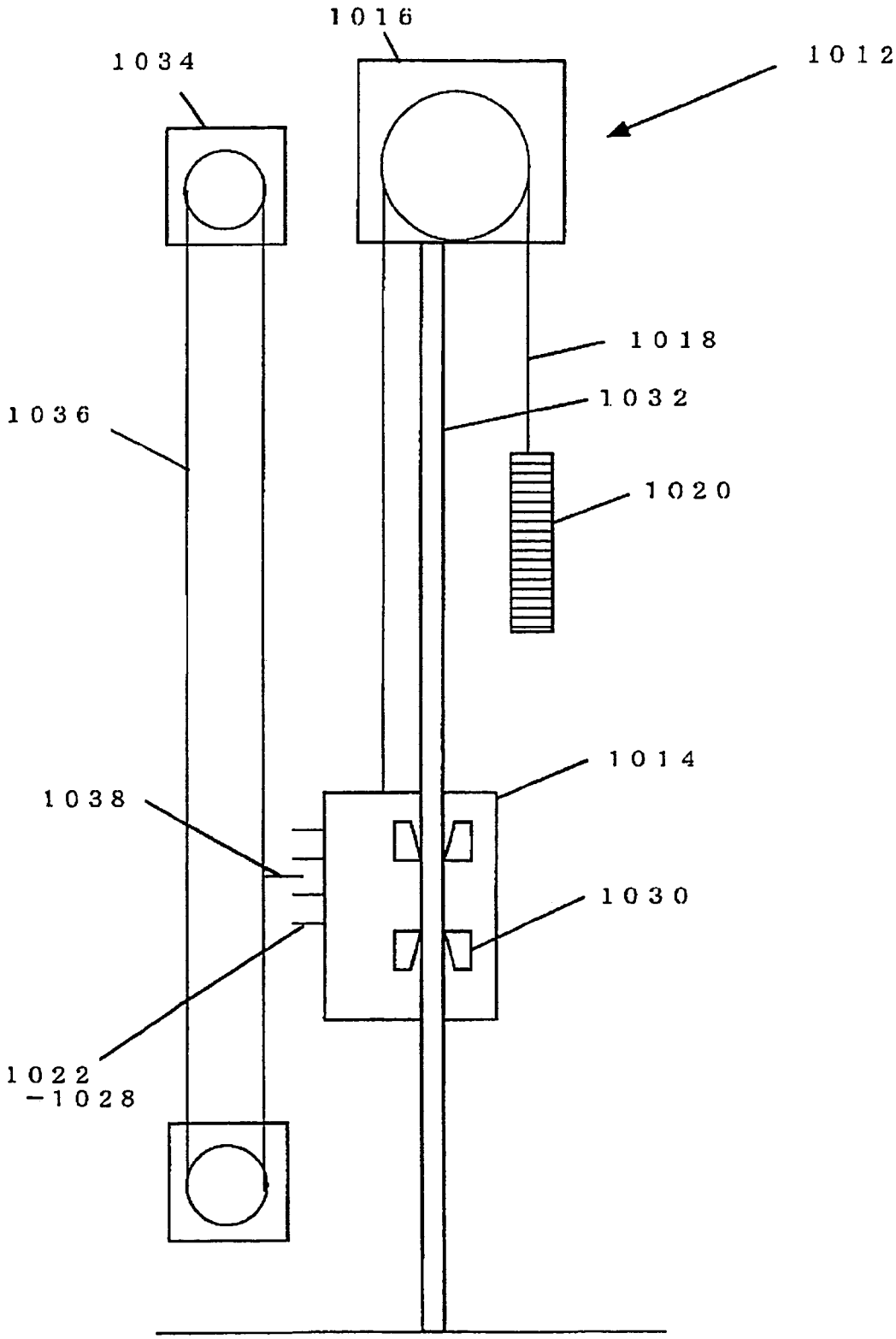
Fig.22 PRIOR ART
FIG. 22 a schematic diagram of another conventional elevator apparatus.

In a speed governor 1 for an elevator, which is used for a double-car elevator apparatus or a multi-car elevator apparatus shown in FIG. 20, car position information 85, relative position information 95 with respect to an object car, relative speed information 105 with respect to the object car, and operation command information 25 are inputted to an overspeed detection level determining means 12. When these information is inputted, the overspeed detection level determining means 12 determines a first overspeed detection level 125 and a second overspeed detection level 126 on the basis of the car position information 85, the relative position information 95 with respect to the object car, the relative speed information 105 with respect to the object car, a destination floor, an operation speed command value, a destination floor of the object car, and an operation speed command value of the object car, which are included in the operation command information 25. Next, the first overspeed detection level 125, the second overspeed detection level 126 and the car speed information 35 are inputted to an overspeed travel judging means 11 and their levels are compared. When the car speed information 35 is higher than the first overspeed detection level 125, the overspeed travel judging means 11 conveys this to a brake operating means 13 for a winding machine. Then, the brake operating means 13 outputs a brake operation command 55 for the winding machine to operate a brake 50 for the winding machine. When the car speed information 35 is higher than the second overspeed detection level 126, the overspeed travel judging means 11 conveys this to an emergency stop operating means 14. Then, the emergency stop operating means 14 outputs an emergency stop operation command 65 to operate an emergency stop 60. In this embodiment, the overspeed detection levels were determined by the car position and the relative position with respect to the object car in an elevator shaft, the relative speed with respect to the object car, the operation speed command value, the destination floor, the operation speed command value of the object car, and the destination floor of the object car, but not all of them are necessary as the information for detecting the overspeed detection levels.

In the embodiments as above, as to the timing for correcting an error in the car position information 45, correction is made when the car passes the installation position of the car position detecting means 70. As the installation position for the car position detecting means 70, a landing relay installed in the vicinity of each floor can be used. In this case, it is possible to correct the car position automatically in accordance with the elevator shaft while the car is travelling. The car position detecting means 70 may also be installed in the vicinity of floors where the number of stops is large, such as the terminal floors. In this case, it is possible to correct the car position automatically in accordance with the elevator shaft each time the car passes or stops at the installation floor for the car position detecting means 70. The car position detecting means 70 may also be installed at an optional position in the elevator shaft. In this case, if the car does not pass the installation position of the car position detecting means 70 within a certain time, the car is so contrived that it is surely operated to the installation position of the car position detecting means 70, and so on, whereby position adjustment in accordance with the elevator shaft can be made.

As described above, according to the elevator apparatus of the present invention, on-the-spot adjustment or long-time maintenance becomes unnecessary, and the overspeed detection levels can easily be changed depending on the conditions of the car.

What is claimed is:

1. An elevator apparatus for decelerating an elevator car when moving at an excessive speed in an elevator shaft, the apparatus comprising:

a first car position detector for continuously detecting position of the elevator car moving in the elevator shaft, as first position information;

a second car position detector for intermittently detecting the position of the elevator car moving in the elevator shaft, as second position information;

position information correction means, receiving the first and second position information, for correcting the first position information based on the second position information, to produce corrected position information;

overspeed determining means for determining at least one overspeed detection level based on the corrected position information;

a car speed detector for detecting speed of the elevator car moving in the elevator shaft;

comparison means for comparing the at least one overspeed detection level determined to the speed detected; and decelerating means for decelerating the elevator car when at least one of the overspeed detection levels is exceeded by the speed detected.

2. The elevator apparatus of claim 1, wherein, the at least one overspeed detection level is changed in accordance with travel of the elevator car to a destination floor.

3. The elevator apparatus of claim 1, wherein the at least one overspeed detection level is changed in accordance with an operation speed command value supplied to the overspeed determining means.

4. The elevator apparatus of claim 1, wherein the overspeed determining means determines at least first and second overspeed detection levels and the decelerating means includes:

a brake for reducing speed of the elevator car in the shaft when the first overspeed detection level is exceeded by the speed detected; and an emergency brake for stopping movement of the elevator car when the second overspeed detection level, indicating a higher speed than the first overspeed detection level, is exceeded by the speed detected.

* * * * *